US010832837B2

(12) United States Patent
Shinoura et al.

(10) Patent No.: US 10,832,837 B2
(45) Date of Patent: Nov. 10, 2020

(54) CHIP RESISTOR AND METHOD FOR MANUFACTURING THE SAME

(71) Applicant: ROHM CO., LTD., Kyoto (JP)

(72) Inventors: Takanori Shinoura, Kyoto (JP); Wataru Imahashi, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/570,447

(22) Filed: Sep. 13, 2019

(65) Prior Publication Data

US 2020/0005972 A1 Jan. 2, 2020

Related U.S. Application Data

(63) Continuation of application No. 15/977,143, filed on May 11, 2018, now Pat. No. 10,453,593, which is a (Continued)

(30) Foreign Application Priority Data

Feb. 19, 2015 (JP) ..... 2015-030590
Mar. 9, 2015 (JP) ..... 2015-045972
Jan. 26, 2016 (JP) ..... 2016-012067

(51) Int. Cl.
*H01C 1/142* (2006.01)
*H01C 17/00* (2006.01)
(Continued)

(52) U.S. Cl.
CPC ..... *H01C 1/142* (2013.01); *H01C 17/006* (2013.01); *H01C 17/02* (2013.01); *H01C 17/242* (2013.01)

(58) Field of Classification Search
CPC ..... H01C 1/142; H01C 17/006; H01C 17/02; H01C 17/242
See application file for complete search history.

(56) References Cited

U.S. PATENT DOCUMENTS 5,379,016 A 1/1995 Smith et al.
5,952,911 A 9/1999 Kawase et al.
(Continued)

FOREIGN PATENT DOCUMENTS

CN 1457469 A 11/2003
CN 201663023 A 12/2010
(Continued)

OTHER PUBLICATIONS

Office Action received in the corresponding Japanese Patent application, dated Sep. 3, 2019, and English machine translation (10 pages).

(Continued)

*Primary Examiner* — Kyung S Lee
(74) *Attorney, Agent, or Firm* — Hamre, Schumann, Mueller & Larson, P.C.

(57) ABSTRACT

A chip resistor includes an upper electrode provided on a substrate, a resistor element connected to the upper electrode, and a side electrode connected to the upper electrode. The side electrode, arranged on a side surface of the substrate, has two portions overlapping with the obverse surface and reverse surface of the substrate, respectively. An intermediate electrode covers the side electrode, and an external electrode covers the intermediate electrode. A first protective layer is disposed between the upper electrode and the intermediate electrode, and held in contact with the upper electrode and the side electrode. The first protective layer is more resistant to sulfurization than the upper electrode. A second protective layer is disposed between the first protective layer and intermediate electrode, and held in contact with the first protective layer, side electrode and intermediate electrode.

18 Claims, 19 Drawing Sheets

Related U.S. Application Data continuation of application No. 15/044,671, filed on Feb. 16, 2016.

(51) Int. Cl.
*H01C 17/02* (2006.01)
*H01C 17/242* (2006.01)

(56) References Cited

U.S. PATENT DOCUMENTS

| | | | | |
|---|---|---|---|---|
| 6,492,896 | B2 * | 12/2002 | Yoneda | H01C 7/003 338/195 |
| 6,703,683 | B2 * | 3/2004 | Tanimura | H01C 7/006 257/536 |
| 6,859,133 | B2 * | 2/2005 | Nakanishi | H01C 7/003 338/309 |
| 6,861,941 | B2 * | 3/2005 | Kuriyama | H01C 1/142 338/309 |
| 7,098,768 | B2 * | 8/2006 | Doi | H01C 1/14 338/309 |
| 7,782,173 | B2 | 8/2010 | Urano et al. | |
| 7,782,174 | B2 | 8/2010 | Urano | |
| 7,825,769 | B2 | 11/2010 | Nomura et al. | |
| 8,193,899 | B2 * | 6/2012 | Takeuchi | H01C 1/06 338/262 |
| 2003/0156008 | A1 | 8/2003 | Nakanishi et al. | |
| 2007/0279182 | A1 * | 12/2007 | Kodas | H01C 17/06506 338/22 R |
| 2010/0201477 | A1 | 8/2010 | Yang et al. | |
| 2011/0234365 | A1 | 9/2011 | Yang et al. | |
| 2015/0217547 | A1 * | 8/2015 | Greb | B32B 17/1022 156/308.6 |
| 2015/0357097 | A1 * | 12/2015 | Tsai | H01C 1/142 338/309 |

FOREIGN PATENT DOCUMENTS

| | | | |
|---|---|---|---|
| JP | 4-279005 | A | 10/1992 |
| JP | 2004-259864 | A | 9/2004 |
| JP | 2007-005373 | A | 1/2007 |
| JP | 2008-135502 | A | 6/2008 |
| JP | 2009-043883 | A | 2/2009 |
| JP | 2012-151195 | A | 8/2012 |
| JP | 2013-258292 | A | 12/2013 |

OTHER PUBLICATIONS

Office Action issued in corresponding Chinese Patent Application, dated Oct. 23, 2017 (7 pages).

* cited by examiner

CHIP RESISTOR AND METHOD FOR MANUFACTURING THE SAME

BACKGROUND OF THE INVENTION

1. Field of the Invention

The present invention relates to chip resistors used in various electronic devices and a method for manufacturing the chip resistors.

2. Description of the Related Art

Conventionally, an internal electrode which is one of the electrodes of a chip resistor may contain silver (Ag). In the case where sulfide gas (such as $H_2S$ or $SO_2$) is present in the surrounding environment of an electric device that includes the chip resistor, the silver in the internal electrode may chemically combine with the sulfide gas to generate silver sulfide ($Ag_2S$). Since silver sulfide is electrically insulative, progress of sulfurization of the internal electrode may cause disconnection of the internal electrode.

Japanese Patent Application Publication No. 2013-258292 (FIG. 2) discloses a chip resistor including an internal electrode (upper electrode) made of an alloy of silver and palladium (i.e., Ag—Pd alloy). Ag—Pd alloy is excellent in sulfurization resistance, and thus prevents sulfurization of the internal electrode. Ag—Pd alloy, however, has a disadvantage of being expensive and economically inefficient.

Japanese Patent Application Publication No. 2012-151195 discloses another method for preventing sulfurization of an internal electrode. In a chip resistor disclosed in the above publication, a protective film is provided to cover a surface of a resistor element. This makes it possible to prevent sulfurization of a part of an electrode (i.e., internal electrode) that makes contact with the resistor element.

In the aforementioned Japanese Patent Application Publication No. 2013-258292 (FIG. 1), a chip resistor is disclosed that includes a first upper electrode (which is made of Ag), and a second upper electrode (which is made of epoxy resin containing metal particles and carbon particles) formed on the first upper electrode. The second upper electrode is less likely to be sulfurized as compared to the first upper electrode, and is cheaper than an electrode made of Ag—Pd alloy. Accordingly, the chip resistor including the second upper electrode has an advantage of being resistant to sulfurization and economically efficient.

On the other hand, the above chip resistor (Japanese Patent Application Publication No. 2013-258292, FIG. 1) further includes a Ni plating layer that covers the second upper electrode. The sulfurization resistance of the second upper electrode increases in proportion to the content of carbon particles. However, when the content of carbon particles exceeds a certain level, the adherence to the Ni plating layer may be weakened, resulting in the Ni plating layer peeling from the second upper electrode.

Furthermore, the temperature of the Ni plating layer may significantly rise depending on the condition of use of the chip resistor. In this case, a thermal shock may occur at a top portion of the Ni plating layer (i.e., a portion in contact with a protective film 14), causing a crack to form in the protective film. As a result, sulfide gas may enter inside through the crack and cause the first upper electrode to be sulfurized and disconnected.

SUMMARY OF THE INVENTION

The present invention has been proposed under the above-described circumstances, and an object thereof is to provide a chip resistor with improved sulfur resistance at low cost and a method for manufacturing the same. Another object of the present invention is to provide a chip resistor that can prevent disconnection of an electrode caused by sulfurization, even if a crack is formed in a protective film by a thermal shock generated at the electrode, and a method for manufacturing the chip resistor.

According to a first aspect of the present invention, a chip resistor may include: a substrate having a first mounting surface and a second mounting surface that face away from each other; a pair of upper electrodes provided at both ends of the first mounting surface of the substrate; side electrodes electrically connected to the upper electrodes, each of the side surfaces having a portion arranged on a side surface of the substrate that is located between the first mounting surface and the second mounting surface of the substrate, and portions overlapping with the first mounting surface and the second mounting surface as viewed in a thickness direction of the substrate; a resistor element provided, on the first mounting surface of the substrate, between the pair of upper electrodes; intermediate electrodes covering the side electrodes; external electrodes covering the intermediate electrodes; first protective layers located between the upper electrodes and the intermediate electrodes to be in contact with the upper electrodes and the side electrodes, where the first protective layers are more resistant to sulfurization than the upper electrodes; and electroconductive second protective layers located between the first protective layers and the intermediate electrodes to be in contact with the first protective layers, the side electrodes and the intermediate electrodes.

Preferably, the first protective layers contain carbon particles.

Preferably, the first protective layers are electrical insulators.

Preferably, the second protective layers contain Ag.

Preferably, the side electrodes are made of Ni—Cr alloy.

Preferably, the chip resistor further includes a pair of rear electrodes provided at both ends of the second mounting surface of the substrate, wherein the side electrodes are electrically connected to the rear electrodes.

Preferably, the rear electrodes are covered with the intermediate electrodes.

Preferably, the substrate is an electrical insulator.

Preferably, the substrate is made of alumina.

Preferably, the resistor element has a serpentine shape.

Preferably, the resistor element includes one of $RuO_2$ or Ag—Pd alloy.

Preferably, the resistor element is provided with a trimming groove that penetrates through the resistor element.

Preferably, the intermediate electrodes and the external electrodes are plating layers.

Preferably, the intermediate electrodes are Ni plating layers.

Preferably, the external electrodes are Sn plating layers.

Preferably, the chip resistor further includes a protective film covering the resistor element and parts of the upper electrodes.

Preferably, a part of the first protective layer is covered with the protective film.

Preferably, the protective film includes a lower protective film and an upper protective film.

Preferably, the lower protective film contains glass.

Preferably, the upper protective film contains epoxy resin.

According to a second aspect of the present invention, a method for manufacturing a chip resistor includes the steps of: preparing a sheet-like substrate having a first mounting surface and a second mounting surface that face away from each other, and forming, on the first mounting surface of the sheet-like substrate, an upper electrode having a pair of regions that are spaced apart from each other; mounting a resistor on the first mounting surface of the sheet-like substrate, in a region flanked by the pair of regions of the upper electrode, such that that the resistor is electrically connected to the upper electrode; forming, on an upper surface of the upper electrode, a first protective layer that is more resistant to sulfurization than the upper electrode; forming, on an upper surface of the first protective layer, a second protective layer that is electrically conductive; dividing the sheet-like substrate into a plurality of band-shaped substrates; forming side electrodes on side surfaces of each band-like substrate that are located along both ends of the band-like substrate in a longitudinal direction thereof, and also on the first mounting surface and the second mounting surface, such that the side electrodes are electrically connected to the upper electrode and in contact with the first protective layer and the second protective layer; and forming intermediate electrodes to cover the side electrodes and the second protective layer, and external electrodes to cover the intermediate electrodes.

Preferably, the first protective layer is formed in a process involving printing.

Preferably, the second protective layer is formed in a process involving printing.

Preferably, the side electrodes are formed by physical vapor deposition.

Preferably, the physical vapor deposition is a sputtering method.

Preferably, the resistor element is formed in a process involving printing or a technique involving physical vapor deposition and photolithography.

Preferably, the method further includes the step of dividing each of the elongated substrates into a plurality of pieces, before the step of forming the intermediate electrodes and the external electrodes.

Preferably, the intermediate electrodes and the external electrodes are formed by plating.

Preferably, the method further includes the step of forming, on the second mounting surface of the sheet-like substrate, a rear electrode having a pair of regions that are spaced apart from each other.

Preferably, the method further includes the step of forming a trimming groove that penetrates through the resistor element.

Preferably, the method further includes forming a protective film covering the resistor element and parts of the upper electrode and of the first protective layer.

Preferably, the step of forming the protective film includes the step of forming a lower protective film and the step of forming an upper protective film.

According to a third aspect of the present invention, a chip resistor includes: a substrate having a first mounting surface and a second mounting surface that face away from each other; a pair of upper electrodes provided at both ends of the first mounting surface of the substrate; a resistor element provided, on the first mounting surface of the substrate, between the pair of upper electrodes; a protective film covering the resistor element and parts of the upper electrodes; side electrodes electrically connected to the upper electrodes, each of the side electrodes having a portion arranged on a side surface of the substrate that is located between the first mounting surface and the second mounting surface of the substrate, and portions overlapping with the first mounting surface and the second mounting surface in a plan view of the substrate; intermediate electrodes covering the side electrodes; and external electrodes covering the intermediate electrodes, wherein the protective film includes a lower protective film and an upper protective film that are stacked on each other, and the lower protective film is made of a material that is more resistant to a thermal shock than the upper protective film, and the parts of the upper electrodes are covered with the lower protective film.

Preferably, the upper electrodes and the upper protective film are partially covered with the side electrodes.

Preferably, the chip resistor further includes a protective layer covering at least parts of upper surfaces of the upper electrodes and being more resistant to sulfurization than the upper electrodes, wherein at least parts of the protective layer are covered with the side electrodes.

Preferably, a part of the protective layer is covered with the upper protective film.

Preferably, the protective layer includes carbon particles.

Preferably, the protective layer is an electrical insulator.

Preferably, the lower protective film includes glass.

Preferably, the upper protective film includes epoxy resin.

Preferably, the side electrodes are made of Ni—Cr alloy.

Preferably, the chip resistor further includes a pair of rear electrodes provided at both ends of the second mounting surface of the substrate, wherein the side electrodes are electrically connected to the rear electrodes.

Preferably, the rear electrodes are covered with the intermediate electrodes.

Preferably, the substrate is an electrical insulator.

Preferably, the substrate is made of alumina.

Preferably, the resistor element is provided with a trimming groove that penetrates through the resistor element.

Preferably, the intermediate electrodes and the external electrodes are plating layers.

Preferably, the intermediate electrodes are Ni plating layers.

Preferably, the external electrodes are Sn plating layers.

According to a fourth aspect of the present invention, a method for manufacturing a chip resistor includes the steps of: preparing a sheet-like substrate having a first mounting surface and a second mounting surface that face away from each other, and forming, on the first mounting surface of the sheet-like substrate, an upper electrode having a pair of regions that are spaced apart from each other; mounting a resistor on the first mounting surface of the sheet-like substrate, in a region flanked by the pair of regions of the upper electrode, such that that the resistor is electrically connected to the upper electrode; forming a lower protective film covering the resistor element and a part of the upper electrode; forming an upper protective film covering the lower protective film; dividing the sheet-like substrate into a plurality of band-shaped substrates; forming side electrodes on side surfaces of each band-like substrate that are located along both ends of the band-like substrate in a longitudinal direction thereof, and also on the first mounting surface and the second mounting surface, such that the side electrodes are electrically connected to the upper electrode; and forming intermediate electrodes covering the side electrodes and external electrodes covering the intermediate electrodes.

Preferably, the side electrodes are formed to partially cover the upper electrode and the upper protective film.

Preferably, the method further includes the step of forming a protective layer that covers at least a part of an upper surface of the upper electrode and is more resistant to sulfurization than the upper electrode.

Preferably, the protective layer is formed in a process involving printing.

Preferably, the side electrodes are formed to cover at least a part of the protective layer.

Preferably, the upper protective film is formed to cover a part of the protective layer.

Preferably, the lower protective film is formed in a process involving printing.

Preferably, the upper protective film is formed in a process involving printing.

Preferably, the side electrodes are formed by physical vapor deposition.

Preferably, the physical vapor deposition is a sputtering method.

Preferably, the intermediate electrodes and the external electrodes are formed by plating.

Preferably, the method further includes the step of dividing each of the elongated substrates into a plurality of pieces, before the step of forming the intermediate electrodes and the external electrodes.

Preferably, the method further includes the step of forming, on the second mounting surface of the sheet-like substrate, a rear electrode having a pair of regions that are spaced apart from each other.

Preferably, the method further includes the step of forming a trimming groove that penetrates through the resistor element.

The chip resistor according to the present invention includes a first protective layer that is located between an upper electrode and an intermediate electrode and that is in contact with the upper electrode and the side electrode. In this way, the upper electrode is covered with the first protective layer. The first protective layer is more resistant to sulfurization than the upper electrode. Accordingly, the first protective layer prevents sulfurization and disconnection of the upper electrode. The chip resistor according to the present invention further includes a second protective layer in addition to the first protective layer, and the second protective layer is located between the first protective layer and the intermediate electrode and is in contact with the first protective layer, the side electrode, and the intermediate electrode. The first protective layer is covered with the second protective layer and the side electrode that are electrically conductive. Accordingly, the intermediate electrode is not in contact with the first protective layer. This makes it possible to prevent peeling of a Ni plating layer serving as the intermediate electrode. As described above, the resistor includes the first protective layer and the second protective layer, and the chip resistor can therefore be manufactured at low cost with improved sulfurization resistance.

In addition, the chip resistor according to the present invention includes a lower protective film and an upper protective film that are stacked on each other, and a part of the upper electrode is covered with the lower protective film. The lower protective film is made of a material that is more resistant to a thermal shock than the upper protective film. Accordingly, even if a crack occurs in the upper protective film due to a thermal shock at top portions of plating layers that serve as the intermediate electrode and the external electrode (i.e., boundary between the plating layers and the upper protective film in plan view), the lower protective film prevents development of the crack. Since the crack does not cause exposure of the upper electrode, the sulfide gas generated in the vicinity of the chip resistor does not enter the upper electrode via the crack. Accordingly, even if a crack occurs in the upper protective film due to a thermal shock at an electrode, disconnection of the electrode caused by sulfurization can be prevented.

Other features and advantages of the present invention will become apparent from the detailed description given below with reference to the accompanying drawings.

DESCRIPTION OF THE PREFERRED EMBODIMENTS

The following describes the embodiments for implementing the present invention, with reference to the attached drawings.

First Embodiment

Figure 1:
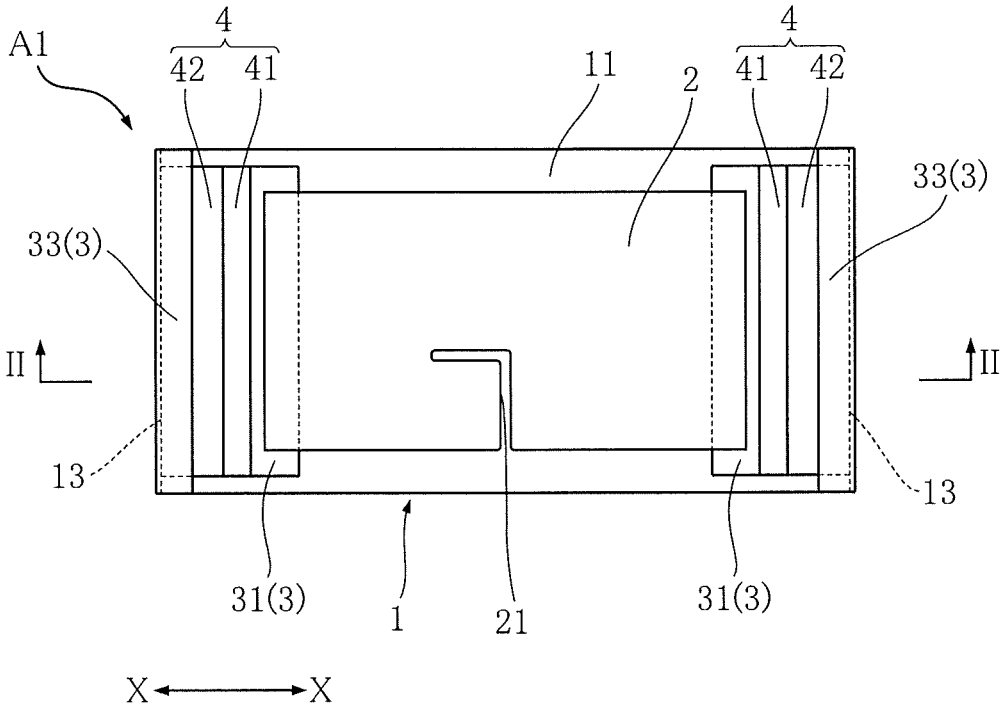
FIG. 1 is a plan view showing a chip resistor according to a first embodiment of the present invention.
Figure 2:
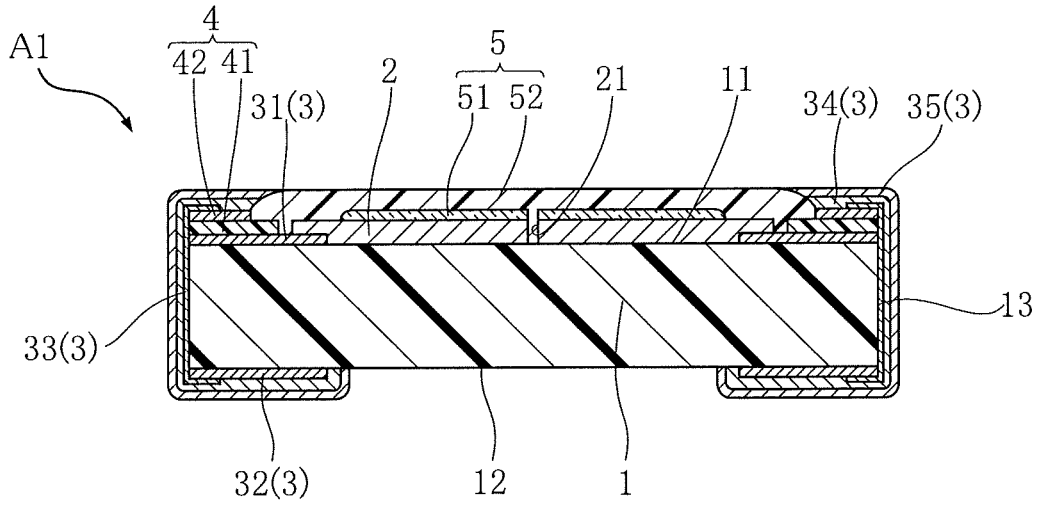
FIG. 2 is a cross-sectional view along the line II-II in FIG. 1.
Figure 3:
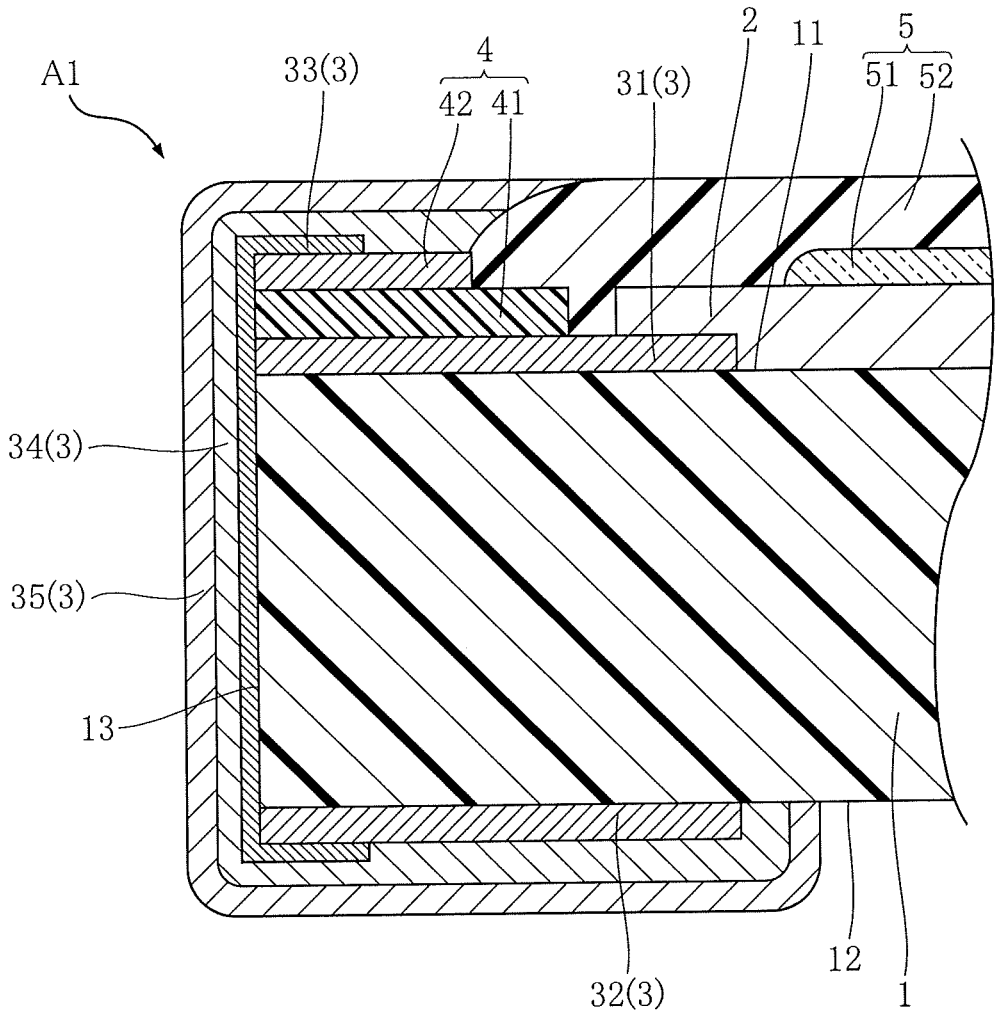
FIG. 3 is a partial enlarged cross-sectional view showing a part of FIG. 2.

The following describes a chip resistor A1 according to a first embodiment of the present invention, with reference to FIGS. 1 to 3. FIG. 1 is a plan view showing the chip resistor A1. FIG. 2 is a cross-sectional view along the line II-II in FIG. 1. FIG. 3 is a partial enlarged cross-sectional view showing a part of FIG. 2. For the convenience of understanding, FIG. 1 does not show an intermediate electrode 34, an external electrode 35, or a protection film 5, which are described later.

The chip resistor A1 shown in these figures is designed to be mounted on a surface of a circuit board in one of various electronic devices. The chip resistor A1 includes a substrate 1, a resistor element 2, electrodes 3, a protective layer 4, and a protective film 5. In the present embodiment, the chip resistor A1 is rectangular in plan view. The chip resistor A1 is a thick film (metal-glaze film) chip resistor.

As shown in FIGS. 1 and 2, the substrate 1 is a member on which the resistor element 2 is mounted, and is used to mount the chip resistor A1 on a circuit board in one of various electronic devices. The substrate 1 is an electrical insulator. In the present embodiment, the substrate 1 is made of alumina ($Al_2O_3$), for example. It is preferable that the substrate 1 be made of a highly heat-conductive material, so that the heat generated by the resistor element 2 is easily dissipated outside while the chip resistor A1 is in use. The substrate 1 has a first mounting surface 11, a second mounting surface 12, and side surfaces 13. In the present embodiment, the substrate 1 is rectangular in plan view.

The first mounting surface 11 is an upper surface of the substrate 1 shown in FIG. 2, which is a surface on which the resistor element 2 is mounted. The second mounting surface 12 is a lower surface of the substrate 1 shown in FIG. 2, which is a surface used when the chip resistor A1 is mounted on a circuit board in one of various electronic devices. The first mounting surface 11 and the second mounting surface 12 face away from each other. As shown in FIGS. 1 and 2, the side surfaces 13 are a pair of surfaces that are perpendicular to the first mounting surface 11 and the second mounting surface 12, and that face away from each other in the longitudinal direction (i.e, direction X in FIG. 1) of the substrate 1. The side surfaces are located between the first mounting surface 11 and the second mounting surface 12.

The resistor element 2 is an element that performs functions such as limiting or detecting electric current. In the present embodiment, the resistor element 2 has the shape of a band that extends in the direction X shown in FIG. 1 when seen in plan view. The resistor element 2 is made of, for example, a paste containing metal such as $RuO_2$ or Ag—Pd alloy. Although the resistor element 2 is band-shaped in plan view in the present embodiment, it may have a different shape such as a serpentine shape. The resistor element 2 has a trimming groove 21.

As shown in FIGS. 1 and 2, the trimming groove 21 extends through the resistor element 2 in a thickness direction thereof. Owing to the trimming groove 21, an opening is formed in a side surface of the resistor element 2 along the longitudinal direction (direction X shown in FIG. 1) of the resistor element 2. In the present embodiment, the trimming groove 21 formed in the resistor element 2 is L-shaped in plan view. The trimming groove 21 is formed so as to adjust the resistance value of the resistor element 2 to a required value.

As shown in FIGS. 1 to 3, the electrodes 3 are a pair of members that are spaced apart from each other. The electrodes 3 are electrically connected to the resistor element 2, and connect the chip resistor A1 to a wiring pattern on a circuit board in one of various electronic devices. The electrodes 3 flank the resistor element 2 on both sides in the direction X shown in FIG. 1. In the present embodiment, the electrodes 3 include an upper electrode 31, a rear electrode 32, a side electrode 33, an intermediate electrode 34, and an external electrode 35.

As shown in FIGS. 1 to 3, the upper electrode 31 includes a pair of regions that are spaced apart from each other and arranged on both ends on the first mounting surface 11 of the substrate 1. The upper electrode 31 is rectangular in plan view. The upper electrode 31 is partially sandwiched between the first mounting surface 11 and the resistor element 2. Accordingly, the resistor element 2 is electrically connected to the upper electrode 31. The upper electrode 31 is made of a paste containing silver (Ag), for example.

As shown in FIGS. 1 to 3, the rear electrode 32 includes a pair of regions that are spaced apart from each other and arranged on both ends on the second mounting surface 12 of the substrate 1. The rear electrode 32 has substantially the same shape as the upper electrode 31 in plan view (not shown). The rear electrode 32 is made of a paste containing Ag, for example, similarly to the upper electrode 31. Note that the rear electrode 32 may be omitted.

As shown in FIGS. 1 to 3, the side electrode 33 includes a pair of regions that are spaced apart from each other and arranged on the side surfaces 13 of the substrate 1. The side electrode 33 covers parts of the upper electrode 31, the rear electrode 32, and the protective layer 4, as well as the side surfaces 13. That is, the side electrode 33 has portions arranged on the side surfaces 13, and portions overlapping with the first mounting surface 11 and second mounting surface 12 of the substrate 1 in the thickness direction of the substrate 1. The side electrode 33 allows the upper electrode 31 and the rear electrode 32 to be electrically connected to each other. Accordingly, the upper electrode 31 and the side electrode 33 allow the resistor element 2 to be electrically connected to the rear electrode 32. In the present embodiment, the side electrode 33 is an alloy of nickel and chromium (i.e., Ni—Cr alloy), for example. The side electrode 33 may be made of any metal as long as it is electrically conductive and resistant to sulfurization.

As shown in FIGS. 2 and 3, the intermediate electrode 34 includes a pair of regions that are spaced apart from each other and cover the rear electrode 32, the side electrode 33, and the protective layer 4. In the present embodiment, the intermediate electrode 34 is a nickel (Ni) plating layer, for example. The intermediate electrode 34 protects the electrodes 3 from heat and shock.

As shown in FIGS. 2 and 3, the external electrode 35 includes a pair of regions that are spaced apart from each other and cover the intermediate electrode 34. In the present embodiment, the external electrode 35 is a tin (Sn) plating layer, for example. Solder is applied to the external electrode 35 so that the external electrode 35 is integrated with the solder, whereby the chip resistor A1 is connected to a wiring pattern on a circuit board in one of various electronic devices. In the present embodiment, the intermediate electrode 34 is a Ni plating layer, which makes it difficult to directly attach solder to the intermediate electrode 34. For this reason, the external electrode 35 in the form of a Sn plating layer is necessary.

As shown in FIGS. 1 to 3, the protective layer 4 includes a pair of regions that are spaced apart from each other and cover at least a part of the upper electrode 31. In the present embodiment, the protective layer 4 includes a first protective layer 41 and a second protective layer 42. The protective layer 4 prevents sulfurization of the upper electrode 31.

The first protective layer 41 includes a pair of regions that are spaced apart from each other and formed on an upper surface of the upper electrode 31 shown in FIGS. 2 and 3. The first protective layer 41 is more resistant to sulfurization than the upper electrode 31. The first protective layer 41 is located between the upper electrode 31 and the intermediate electrode 34, and is in contact with the upper electrode 31 and the side electrode 33. In the present embodiment, the first protective layer 41 may be made of a paste containing a metal oxide of e.g. ruthenium (Ru), glass, carbon particles (i.e., carbon black), and epoxy resin. In this case, the first protective layer 41 is electrically conductive. The first protective layer 41 may be an electrical insulator. In the case where the first protective layer 41 is an electrical insulator, the first protective layer 41 is made of a paste containing glass, for example.

The second protective layer 42 includes a pair of regions that are spaced apart from each other and formed on an upper surface of the first protective layer 41 shown in FIGS. 2 and 3. The second protective layer 42 is electrically conductive. The second protective layer 42 is located between the first protective layer 41 and the intermediate electrode 34, and is in contact with the first protective layer 41, the side electrode 33, and the intermediate electrode 34. In the present embodiment, the second protective layer 42 is made of a paste containing Ag and epoxy resin, for example.

As shown in FIGS. 1 to 3, the protective film 5 is a member that covers the resistor element 2 and protects the resistor element 2 from the exterior environment. The protective film 5 includes a lower protective film 51 and an upper protective film 52. The lower protective film 51 covers a surface of the resistor element 2 (i.e., an upper surface of the resistor element 2 shown in FIG. 2). The lower protective film 51 is made of a paste containing glass, for example. The upper protective film 52 covers a part of the substrate 1, the resistor element 2, and a part of the upper electrode 31. In the present embodiment, parts of the first protective layer 41 are covered with the upper protective film 52. Note that parts of the upper protective film 52 may be covered with the first protective layer 41. The upper protective film 52 is made of a paste containing epoxy resin, for example.

Next, a method for manufacturing the chip resistor A1 will be described with reference to FIGS. 4 to 15. FIGS. 4 to 11 are plan views showing a step relating to the method for manufacturing the chip resistor A1. FIGS. 12 to 15 are perspective views showing a step relating to the method for manufacturing the chip resistor A1. Note that FIGS. 10 to 15 do not show the lower protective film 51 of the protective film 5 to facilitate understanding. Also, in FIGS. 12 and 13, the thicknesses of the resistor element 2, the upper electrode 31, the side electrode 33, the first protective layer 41, the second protective layer 42, and the upper protective film 52 are disregarded in order to facilitate understanding.

Figure 4:
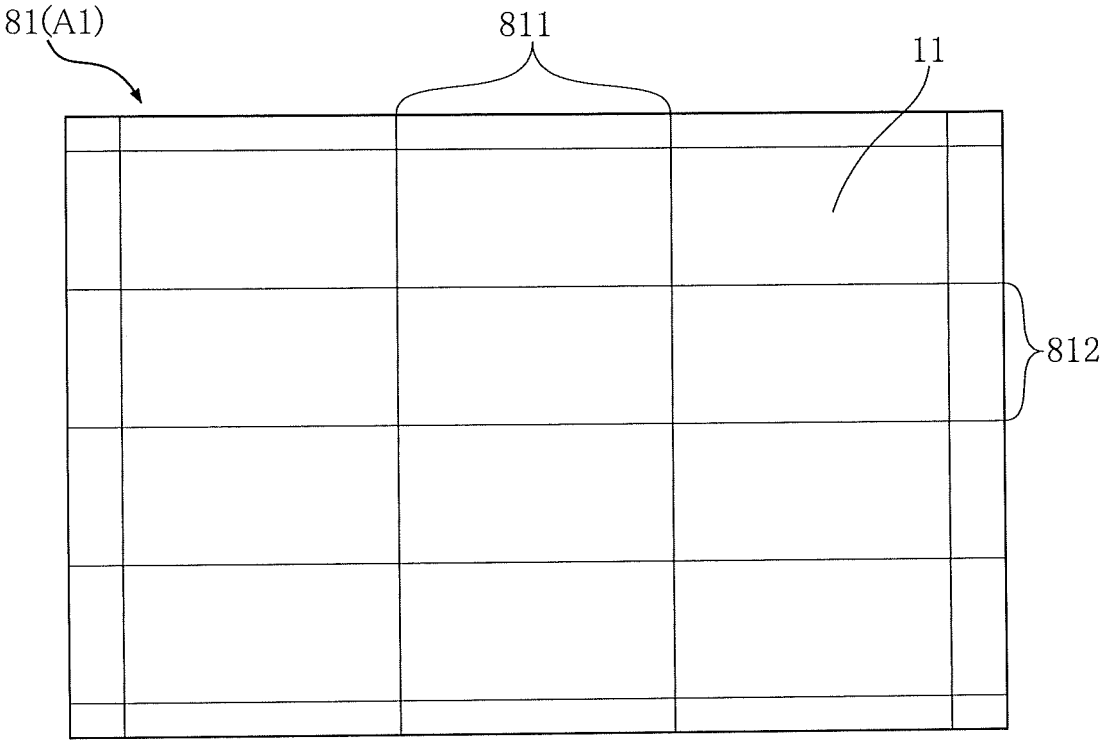
FIG. 4 is a plan view showing a step relating to a method for manufacturing a chip resistor shown in FIG. 1.

First, as shown in FIG. 4, a sheet-like substrate 81, made of alumina, is prepared. The sheet-like substrate 81 has a first mounting surface 11 and a second mounting surface 12. The first mounting surface 11 and the second mounting surface 12 face away from each other. FIG. 4 shows the first mounting surface 11 of the sheet-like substrate 81. In the first mounting surface 11, a plurality of primary dividing grooves 811 in a longitudinal direction in FIG. 4 and a plurality of secondary dividing grooves 812 in a lateral direction in FIG. 4 are formed in a grid pattern. The same number of primary dividing grooves 811 and secondary dividing grooves 812 are formed in the second mounting surface 12 that is located opposite to the first mounting surface 11 (not shown). When seen in plan view, the positions of the primary dividing grooves 811 and the secondary dividing grooves 812 are the same in both the first mounting surface 11 and the second mounting surface 12. The sections created by the primary dividing grooves 811 and the secondary dividing grooves 812 are regions each corresponding to the substrate 1 of the chip resistor A1.

Figure 5:
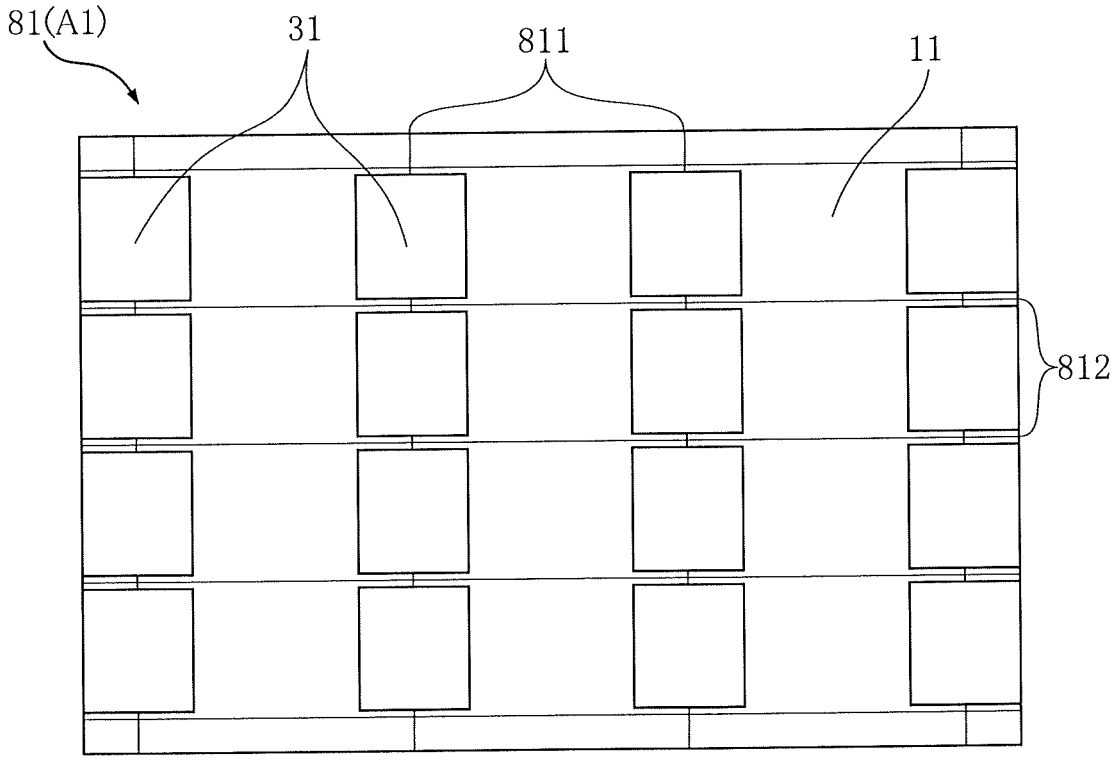
FIG. 5 is a plan view showing a step relating to a method for manufacturing the chip resistor shown in FIG. 1.

Next, as shown in FIG. 5, upper electrodes 31 are formed on the first mounting surface 11 of the sheet-like substrate 81, such that the upper electrodes 31 pass across the primary dividing grooves 811 of the sheet-like substrate 81. In addition, rear electrodes 32 are formed on the second mounting surface 12 of the sheet-like substrate 81, such that the rear electrodes 32 pass across the primary dividing grooves 811 (not shown). When seen in plan view, the positions and the sizes of the upper electrodes 31 and the rear electrodes 32 are substantially the same. In the present embodiment, the upper electrodes 31 and the rear electrodes 32 are formed by printing a Ag paste containing glass frit on the first mounting surface 11 and the second mounting surface 12 with use of a silk screen, and firing the Ag paste in a firing furnace. Through the above step, the upper electrodes 31 and the rear electrodes 32, each including a pair of regions that are spaced part from each other, are formed on the first mounting surface 11 and the second mounting surface 12.

Figure 6:
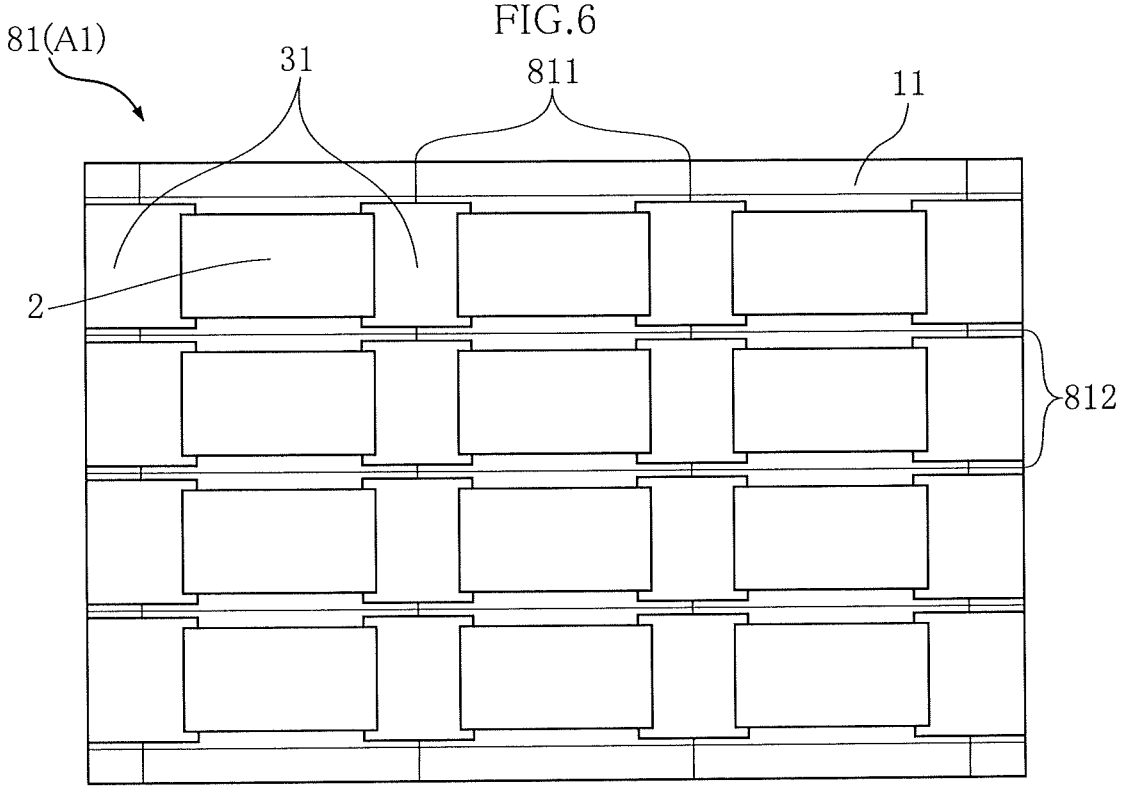
FIG. 6 is a plan view showing a step relating to a method for manufacturing the chip resistor shown in FIG. 1.

Next, as shown in FIG. 6, resistors 2, which are to be electrically connected to the upper electrodes 31, are mounted on the first mounting surface 11 of the sheet-like substrate 81, in the regions flanked by the pairs of regions of the upper electrodes 31. In the present embodiment, the resistors 2 are mounted by printing, with use of a silk screen, a paste containing glass frit and metal, such as $RuO_2$ or Ag—Pd alloy, and then by firing the paste in a firing furnace.

Figure 7:
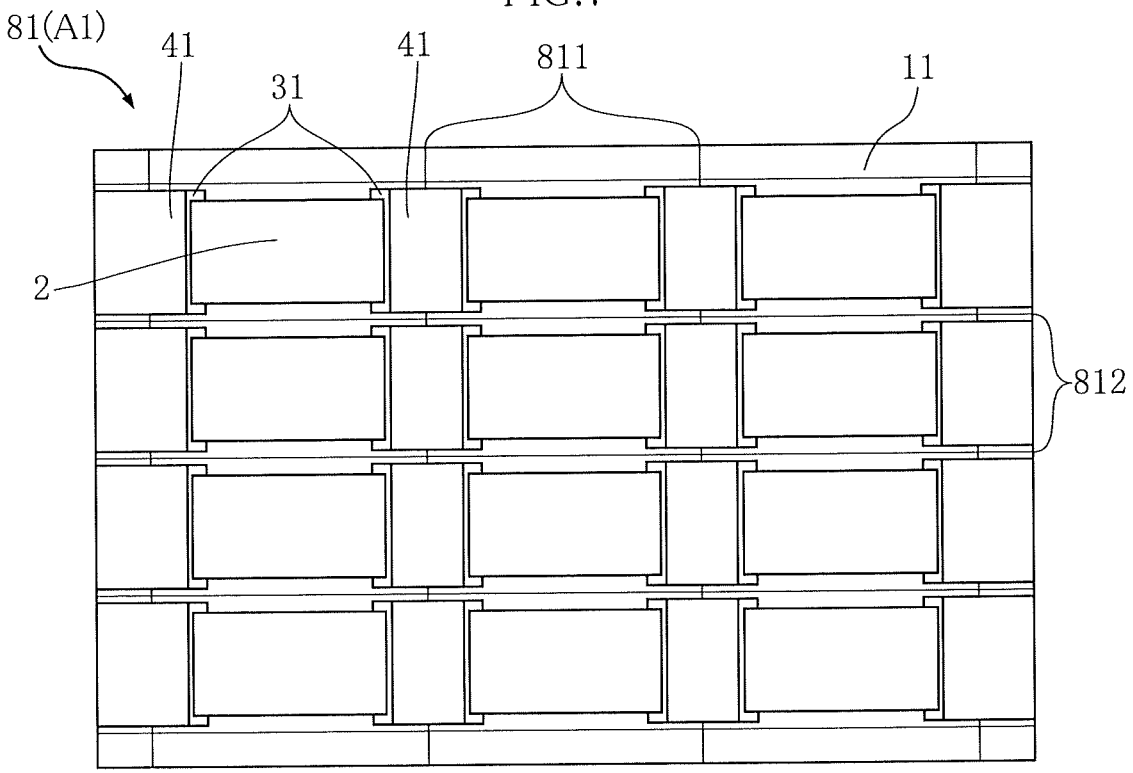
FIG. 7 is a plan view showing a step relating to a method for manufacturing the chip resistor shown in FIG. 1.

Next, as shown in FIG. 7, first protective layers 41, which are more resistant to sulfurization than the upper electrodes 31, are formed on parts of the upper electrodes 31 that are flanked by the resistors 2. In the present embodiment, the first protective layers 41 are formed by printing, with use of a silk screen, a paste containing glass and a metal oxide composed of Ru, etc., for example, carbon black, and epoxy resin, and curing the paste. The first protective layers 41 formed in this manner are electrically conductive. The first protective layers 41 may be formed as electrical insulators by printing a paste containing glass with use of a silk screen, and firing the paste in a firing furnace. In the case where the first protective layers 41 are formed to be electrically conductive, gaps are provided between the first protective layers 41 and the resistors 2 when seen in plan view. In this way, the first protective layers 41 are prevented from being in contact with the resistors 2. The reason why the contact between the first protective layers 41 and the resistors 2 is prevented is because the contact causes the resistance values of the resistors 2 to vary. Through the above step, parts of the upper electrodes 31 are covered with the first protective layers 41.

Figure 8:
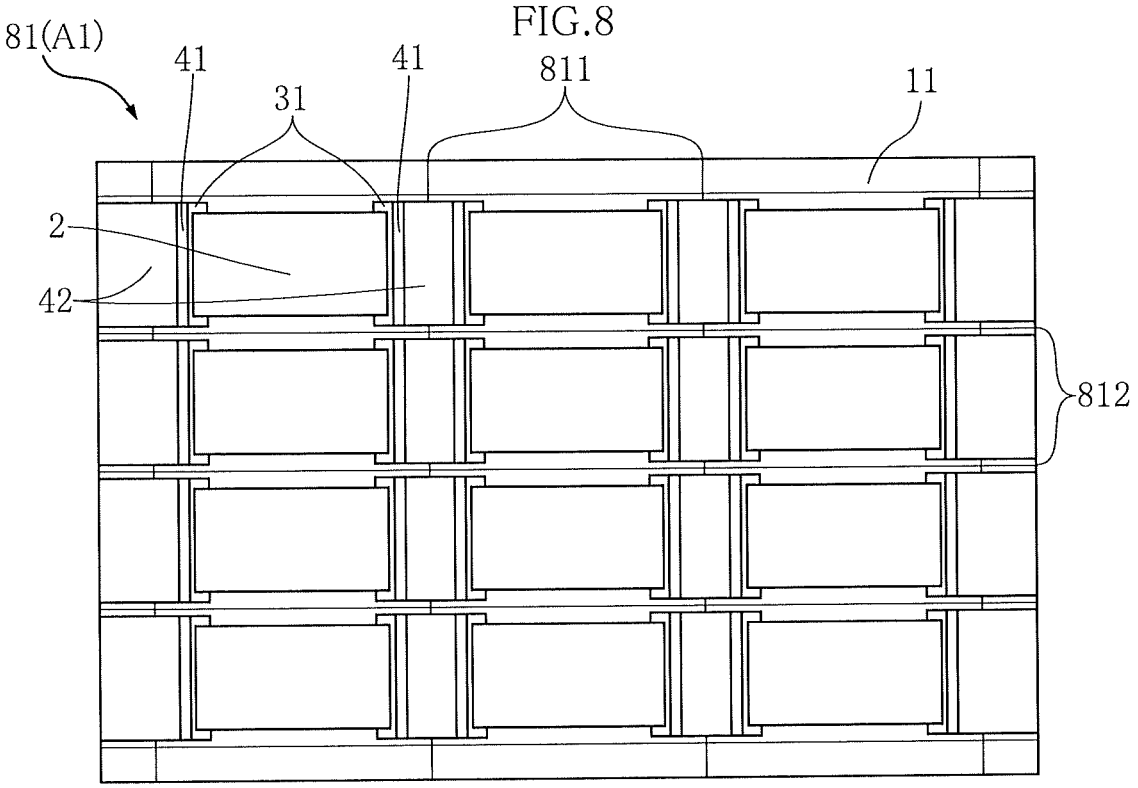
FIG. 8 is a plan view showing a step relating to a method for manufacturing the chip resistor shown in FIG. 1.

Next, as shown in FIG. 8, second protective layers 42 that are electrically conductive are formed on upper surfaces of the first protective layers 41. In the present embodiment, the second protective layers 42 are formed by printing, with use of a silk screen, a paste containing Ag and epoxy resin, and curing the paste. The second protective layers 42 are formed in a manner that the first protective layers 41 are exposed at parts of the second protective layers 42 that are adjacent to the resistors 2. Through the above step, parts of the first protective layers 41 are covered with the second protective layers 42.

Figure 9:
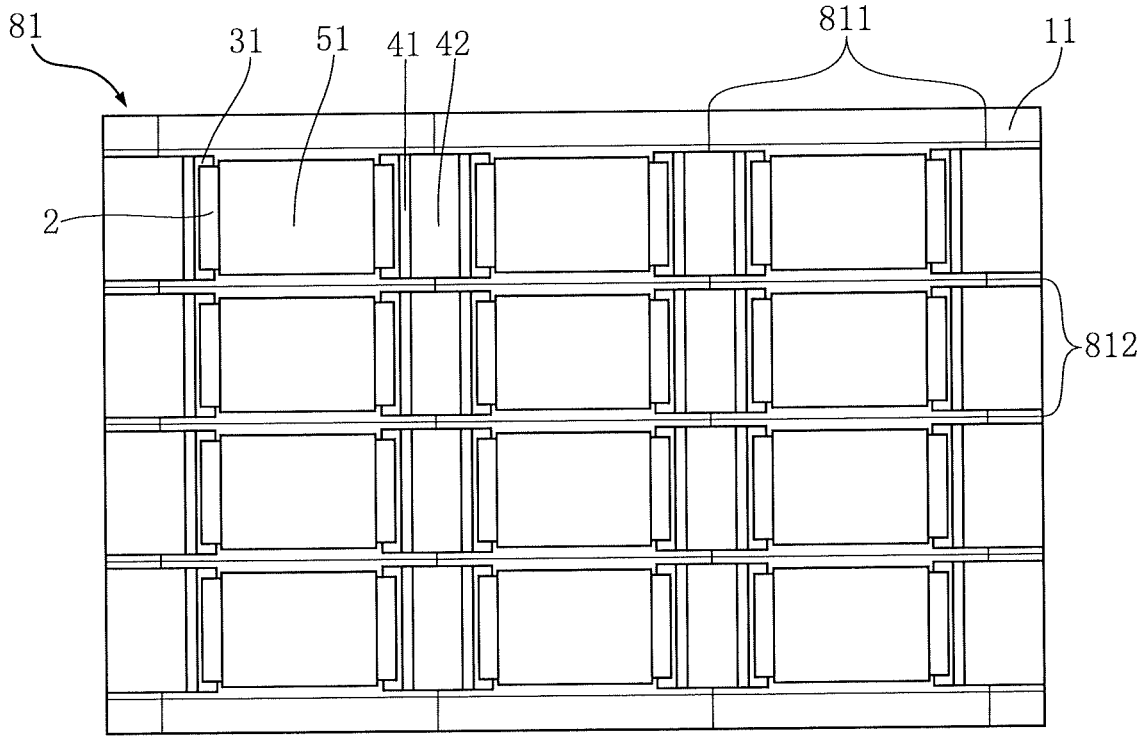
FIG. 9 is a plan view showing a step relating to a method for manufacturing the chip resistor shown in FIG. 1.

Next, as shown in FIG. 9, lower protective films 51 are formed to cover surfaces of the resistors 2. In the present embodiment, the lower protective films 51 are formed by printing a paste containing glass with use of a silk screen, and firing the paste in a firing furnace. In a step subsequent to the above step, trimming grooves 21 are formed in the resistors 2 with a laser, which causes a thermal shock to the resistor element 2 and generation of the fine particles of the resistors 2. During the above step, the lower protective films 51 serve to alleviate the a thermal shock as well as to prevent the resistance values of the resistors 2 from varying as a result of the fine particles re-adhering to the resistors 2.

Figure 10:
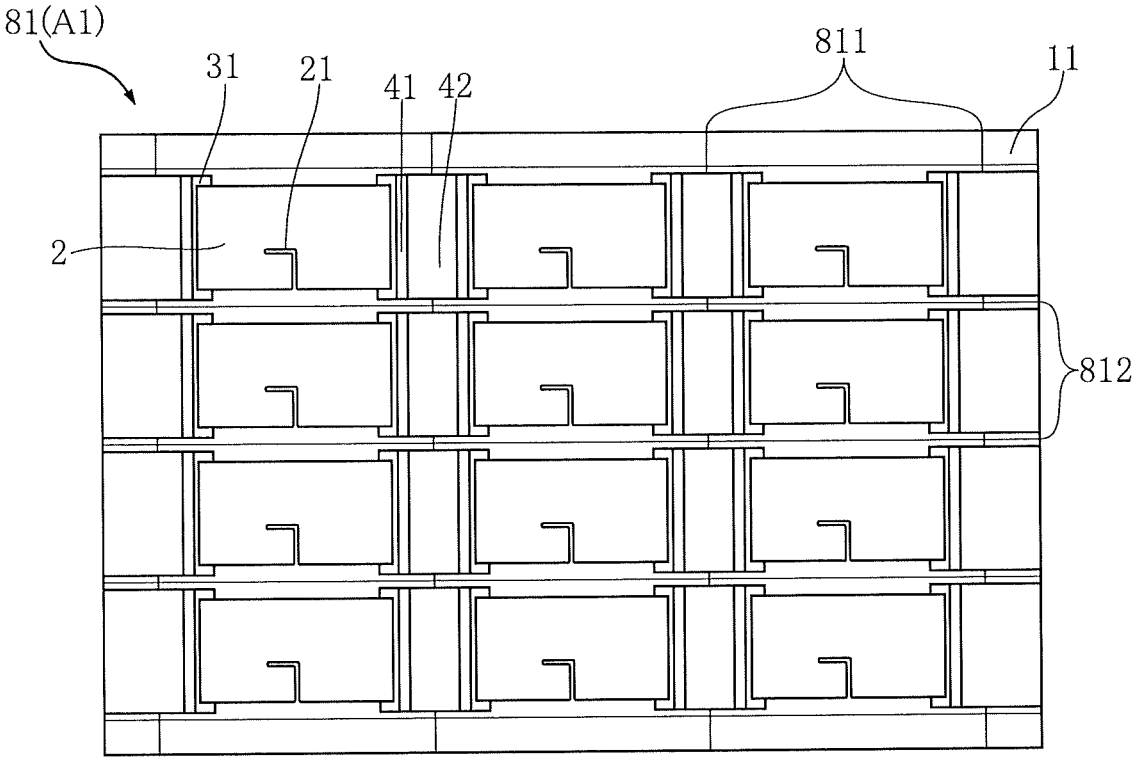
FIG. 10 is a plan view showing a step relating to a method for manufacturing the chip resistor shown in FIG. 1.

Next, as shown in FIG. 10, the trimming grooves 21 are formed in the resistors 2 to extend therethrough. The trimming grooves 21 are formed with a laser trimming apparatus (not shown). The procedure for forming the trimming grooves 21 is as follows. First, the trimming grooves 21 are each formed from one of a pair of side surfaces of the corresponding resistor element 2 along its longitudinal direction to the other side surface, such that the trimming grooves 21 are perpendicular to a direction of current flowing through the resistors 2. After the resistance values of the resistors 2 rise to the values close to the required value for the chip resistors A1, the direction in which the trimming grooves 21 are formed is turned by 90°, so that the direction of the trimming grooves 21 become parallel to the direction of the current flowing through the resistors 2 (i.e., the longitudinal direction of the resistors 2). When the resistance values of the resistors 2 reach the required value for the chip resistors A1, the procedure for forming the trimming grooves 21 is ended. With the above procedure, the trimming grooves 21, which are L-shaped in plan view, are formed in the resistors 2. Note that the trimming grooves 21 are formed in a state where a probe (not shown) for measuring a resistance value is in contact with both ends of each resistor element 2 along the longitudinal direction thereof.

Figure 11:
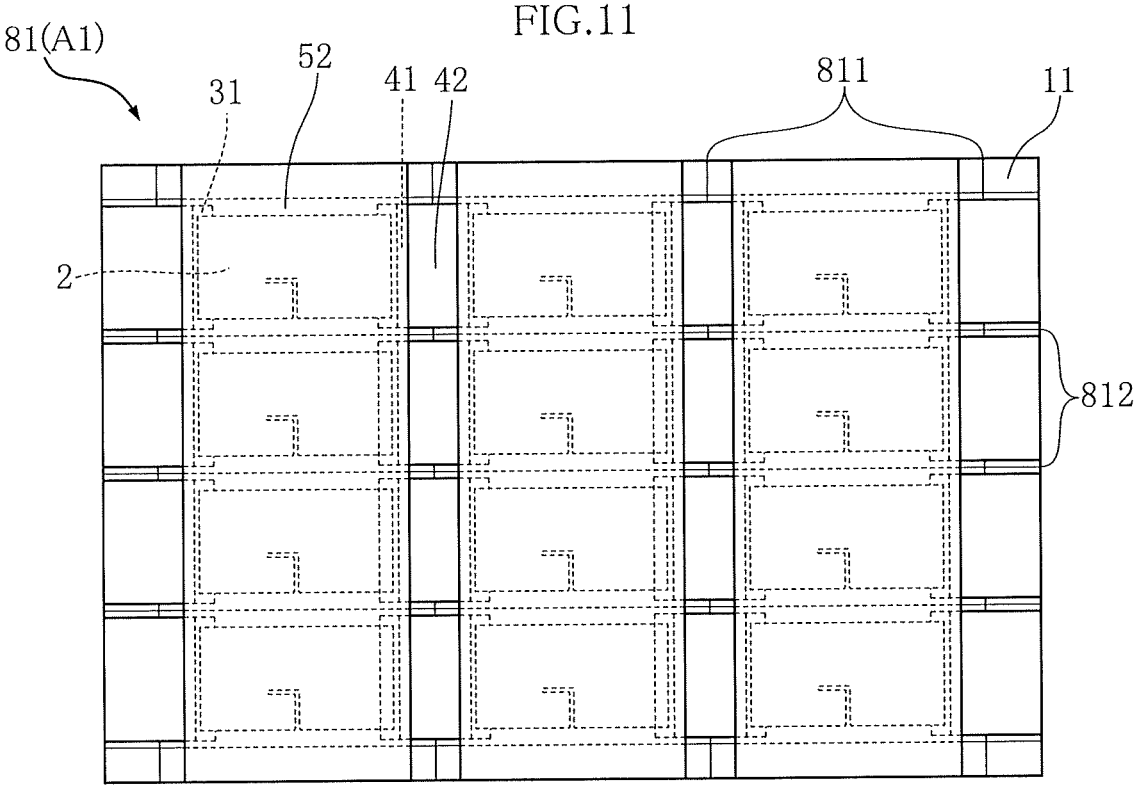
FIG. 11 is a plan view showing a step relating to a method for manufacturing the chip resistor shown in FIG. 1.

Next, as shown in FIG. 11, upper protective films 52 are formed over the first mounting surface 11 of the sheet-like substrate 81. At this time, the resistors 2, as well as parts of the upper electrodes 31 and of the first protective layers 41 are covered with the upper protective films 52. The second protective layers 42 are not covered with the upper protective films 52. In the present embodiment, the upper protective films 52 are formed in the shape of a plurality of bands extending along the primary dividing grooves 811 of the sheet-like substrate 81, such that the upper protective films 52 pass across the secondary dividing grooves 812 of the sheet-like substrate 81. Also, in the present embodiment, the upper protective films 52 are formed by printing a paste containing epoxy resin with use of a silk screen and curing the paste. Note that the upper protective films 52 may be formed to be separate films corresponding one-to-one to the resistors 2, in the same manner as in the lower protective films 51 of protective films 5 shown in FIG. 9.

Figure 12:
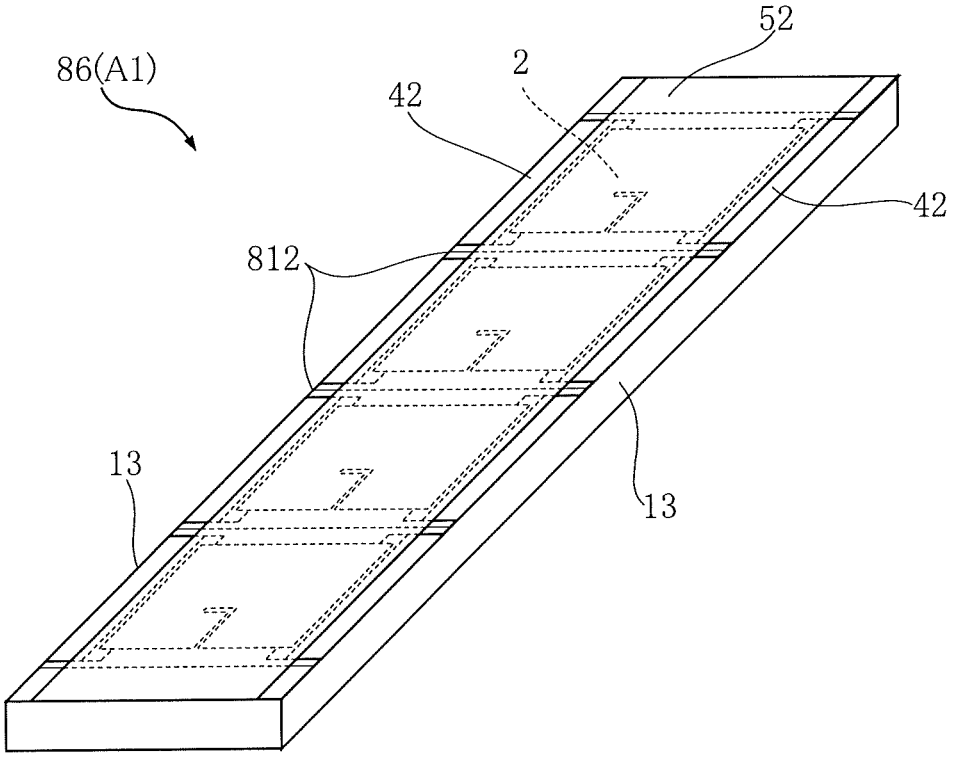
FIG. 12 is a perspective view showing a step relating to a method for manufacturing the chip resistor shown in FIG. 1.

Next, as shown in FIG. 12, the sheet-like substrate 81 is cut along the primary dividing grooves 811 of the sheet-like substrate 81 into a plurality of band-like substrates 86. At this time, side surfaces 13 are formed on both sides of each of the band-like substrates 86 along the longitudinal direction of the band-like substrates 86.

Figure 13:
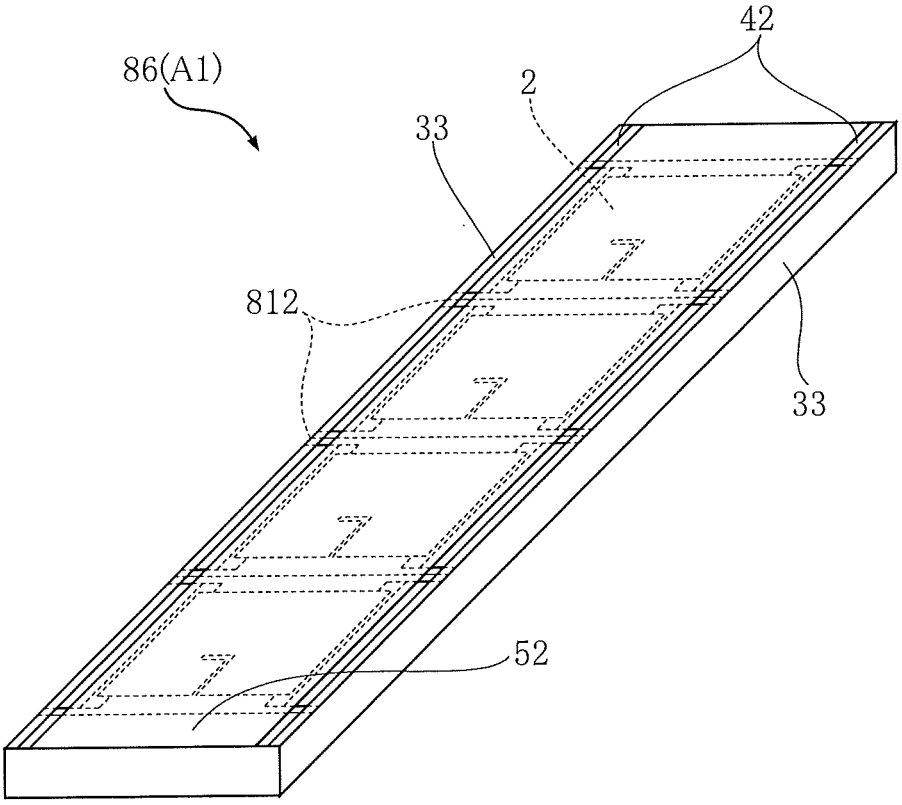
FIG. 13 is a perspective view showing a step relating to a method for manufacturing the chip resistor shown in FIG. 1.

Next, as shown in FIG. 13, side electrodes 33 are formed on the side surfaces 13 of each band-like substrate 86 that are located along both ends of the band-like substrate 86 in the longitudinal direction thereof, and are also formed over parts of the first mounting surface 11 and the second mounting surface 12. In the present embodiment, the side electrodes 33 are formed by forming a film of Ni—Cr alloy by physical vapor deposition (PVD) such as sputtering. In the formation of the side electrodes 33, the side surfaces 13, as well as parts of the respective surfaces of the second protective layers 42 and the rear electrodes 32 that are located perpendicular to the side surfaces, are collectively covered with the side electrodes 33 (the rear electrodes 32 are not shown). At this time, the side electrodes 33 make contact with the respective ends of the second protective layers 42, the first protective layers 41, the upper electrodes 31, and the rear electrodes 32 along the side surfaces 13. Through the above step, the upper electrodes 31 and the rear electrodes 32 become electrically connected to each other by means of the side electrodes 33.

Figure 14:
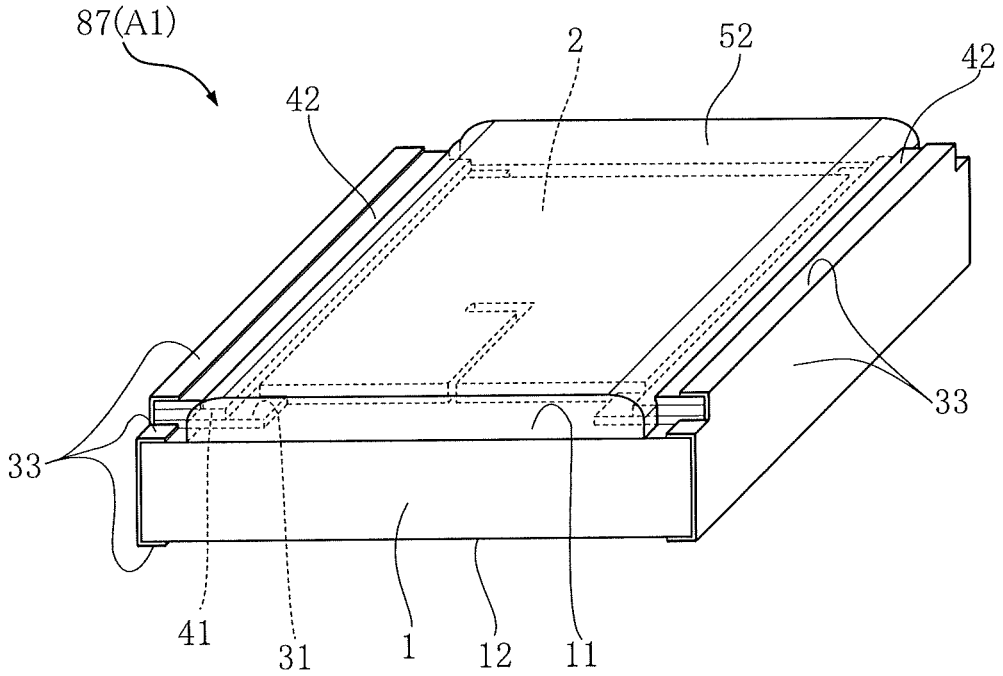
FIG. 14 is a perspective view showing a step relating to a method for manufacturing the chip resistor shown in FIG. 1.

Next, as shown in FIG. 14, the band-like substrates 86 are cut along the secondary dividing grooves 812 of the band-like substrates 86 to be divided into a plurality of pieces 87. At this time, the side electrodes 33 have the shape of a squared U that pinches the substrate 1. The side electrodes 33 are also formed on parts of the first mounting surface 11 and the second mounting surface 12 of the substrate 1. Specifically, the parts are located at both ends of each piece 87 that sandwich the parts of the side electrodes 33 formed on the parts of the surfaces of the second protective layers 42 and the rear electrodes 32 (the rear electrodes 32 are not shown).

Figure 15:
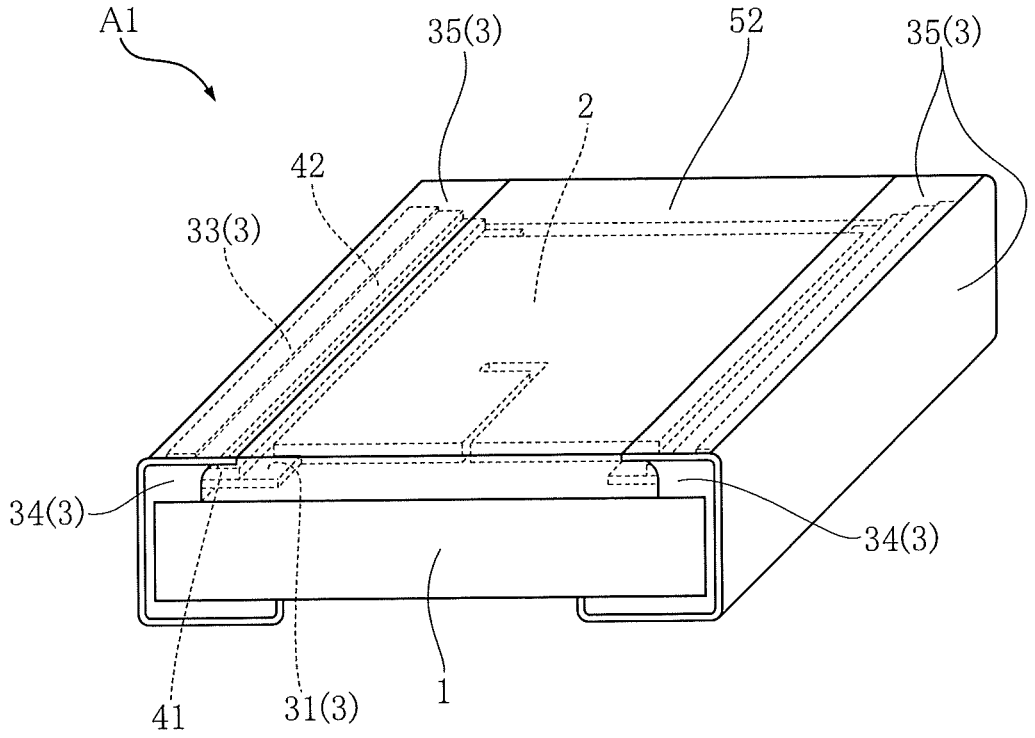
FIG. 15 is a perspective view showing a step relating to a method for manufacturing the chip resistor shown in FIG. 1.

Next, as shown in FIG. 15, for the pieces 87, intermediate electrodes 34 for covering the rear electrodes 32, the side electrodes 33, and the second protective layers 42 are formed, and external electrodes 35 for covering the intermediate electrodes 34 are formed (the rear electrodes 32 are not shown). In the present embodiment, the intermediate electrodes 34 are formed by Ni plating and the external electrodes 35 are formed by Sn plating. Through the above step, pairs of electrodes 3 that electrically connect to the resistors 2 are formed. Upon completion of all of the above steps, chip resistors A1 are formed.

The following describes the operation and effects of the chip resistor A1.

According to the present embodiment, the chip resistor A1 has the first protective layer 41 that is located between the upper electrode 31 and the intermediate electrode 34, and that is in contact with the upper electrode 31 and the side electrode 33. Accordingly, at least a part of the upper electrode 31 is covered with the first protective layer 41. The first protective layer 41 includes carbon particles and therefore is more resistant to sulfurization than the upper electrode 31. Accordingly, the first protective layer 41 prevents sulfurization and disconnection of the upper electrode 31.

The chip resistor A1 also has the second protective layer 42 in addition to the first protective layer 41. The second protective layer 42 is located between the first protective layer 41 and the intermediate electrode 34, and is in contact with the first protective layer 41, the side electrode 33, and the intermediate electrode 34. The second protective layer 42 includes Ag and therefore is electrically conductive. The first protective layer 41 is covered with the second protective layer 42 as well as with the side electrode that is also electrically conductive. Accordingly, the intermediate electrode 34 does not make contact with the first protective layer 41 that includes carbon particles. This makes it possible to prevent peeling of the Ni plating layer serving as the intermediate electrode 34.

As described above, the resistor A1 includes the first protective layer 41 that includes carbon particles and is more resistant to sulfurization than the upper electrode 31, and further includes the second protective layer 42 that includes Ag and is electrically conductive. This makes it possible to manufacture the chip resistor A1 at low cost with improved sulfurization resistance.

A majority of sulfide gas that causes sulfurization of the upper electrode 31, etc. enters the chip resistor A1 along the interface between the upper protective film 52 of the protective film 5 and the plating layers that constitute the intermediate electrode 34 and the external electrode 35. In view of this, parts of the first protective layer 41 are covered with the upper protective film 52 so as to more effectively shield the sulfide gas that enters along the aforementioned interface. Note that even in the structure where the first protective layer 41 covers a part of the upper protective film 52, the chip resistor A1 is still resistant to sulfurization.

If sulfide gas enters along the aforementioned interface, the second protective layer 42 including Ag is sulfurized first. In other words, the second protective layer 42 performs a function similar to a sacrificial electrode. In addition, since the second protective layer 42 does not make contact with the upper electrode 31 due to the first protective layer 41 and the side electrode 33, sulfurization of the upper electrode 31 does not occur even when the second protective layer 42 is sulfurized. Accordingly, with the second protective layer 42 including Ag, the sulfurization resistance of the chip resistor A1 can be further improved.

Sulfurization of the side electrode 33 is prevented by forming the side electrode 33 with Ni—Cr alloy that is electrically conductive and resistant to sulfurization. This prevents disconnection of the side electrode 33 and sulfurization of the upper electrode 31 via the side electrode 33. Also, since the side electrode 33 is formed by physical vapor deposition such as sputtering, the first protective layer 41 that makes contact with the side electrode 33 can be formed as an electrical insulator. In this case, the first protective layer 41 is made of a paste containing glass, for example, which allows for further reduction in the cost of the chip resistor A1.

Second Embodiment

Figure 16:
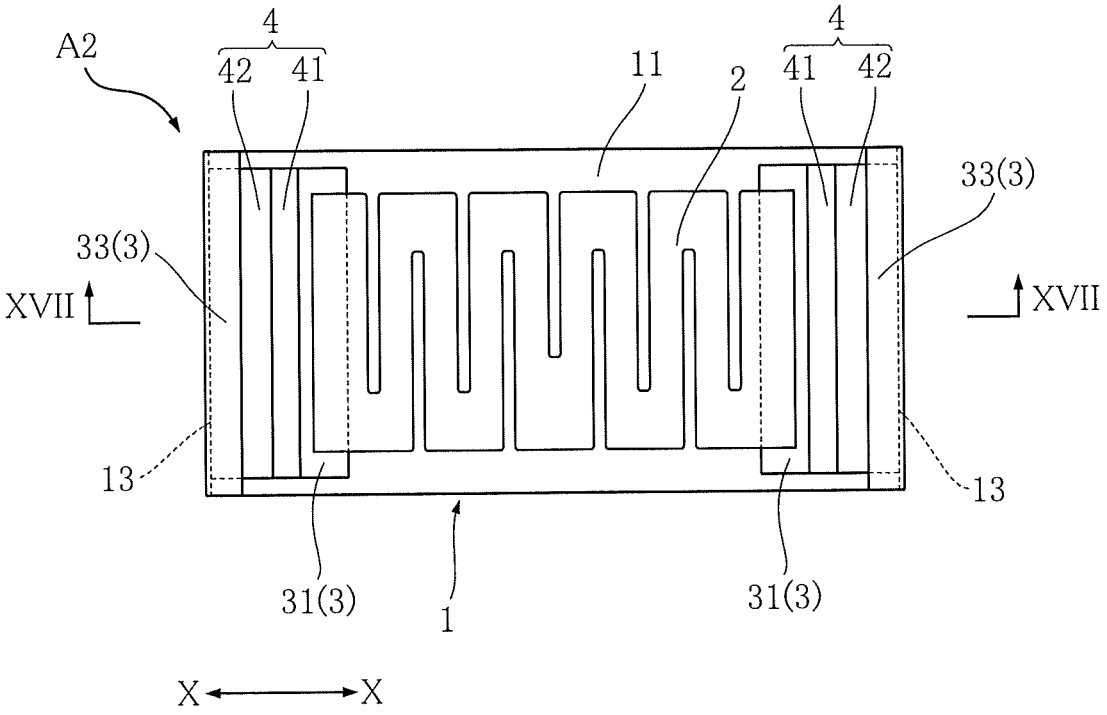
FIG. 16 is a plan view showing a chip resistor according to a second embodiment of the present invention.
Figure 17:
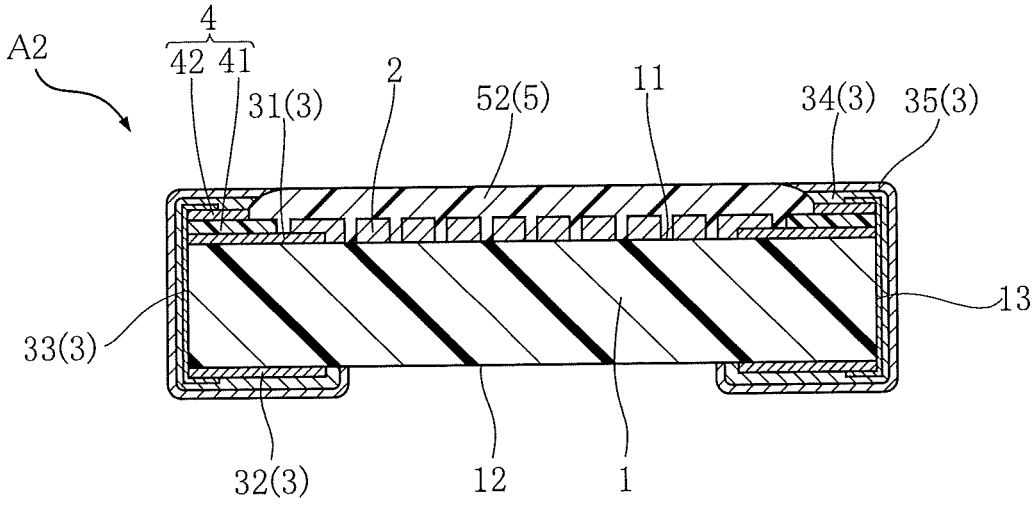
FIG. 17 is a cross-sectional view along the line XVII-XVII in FIG. 16.

The following describes a chip resistor A2 according to a second embodiment of the present invention, with reference to FIGS. 16 and 17. In these figures, elements that are the same as or similar to the elements of the chip resistor A1 described above are provided with the same reference signs, and descriptions thereof are omitted.

FIG. 16 is a plan view showing the chip resistor A2. FIG. 17 is a cross-sectional view along the line XVII-XVII in FIG. 16. For the convenience of understanding, FIG. 16 does not show the intermediate electrode 34, the external electrode 35, or the protection film 5. In the present embodiment, the chip resistor A2 is rectangular in plan view.

The chip resistor A2 differs from the chip resistor A1 in terms of the shape of the resistor element 2 in plan view and the structure of the protective film 5. In the present embodiment, the resistor element 2 has the shape of a serpentine in plan view. The resistor element 2 having the above shape can be formed by first layering the resistor element 2 in an unfinished shape on the first mounting surface 11 of the substrate 1 by physical vapor deposition (PVD) such as sputtering, and thereafter forming the resistor element 2 into the shape of a serpentine by photolithography. In this case, the resistor element 2 is made of Ni—Cr alloy, for example. In other words, the chip resistor A2 is a thin-film chip resistor. Also, in the present embodiment, the lower protective film 51 of the protective film 5 is omitted.

The following describes the operation and effects of the chip resistor A2.

According to the present embodiment, as with the chip resistor A1, the chip resistor A2 includes the first protective layer 41 that includes carbon particles and is more resistant to sulfurization than the upper electrode 31, and further includes the second protective layer 42 that includes Ag and is electrically conductive. This makes it possible to manufacture the chip resistor A2 at low cost with improved sulfurization resistance. Also, since the resistor element 2 is in the shape of a serpentine in plan view, it is possible to increase the resistance value of the chip resistor A2 relative to that of the chip resistor A1 as well as to improve the accuracy of the resistance value.

Third Embodiment

Figure 18:
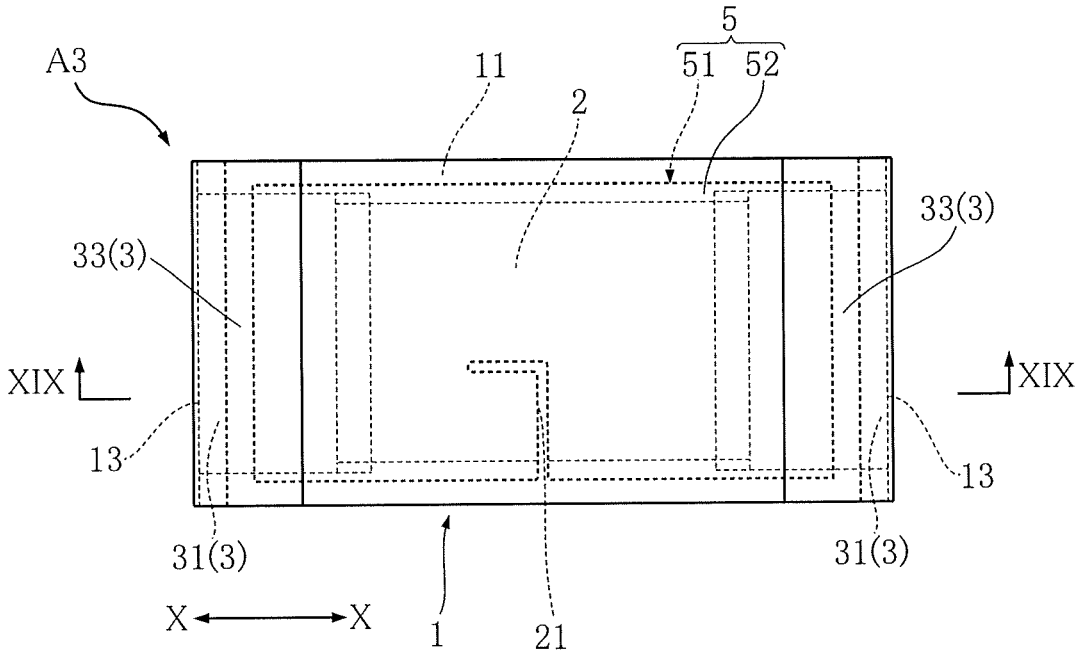
FIG. 18 is a plan view showing a chip resistor according to a third embodiment of the present invention.
Figure 19:
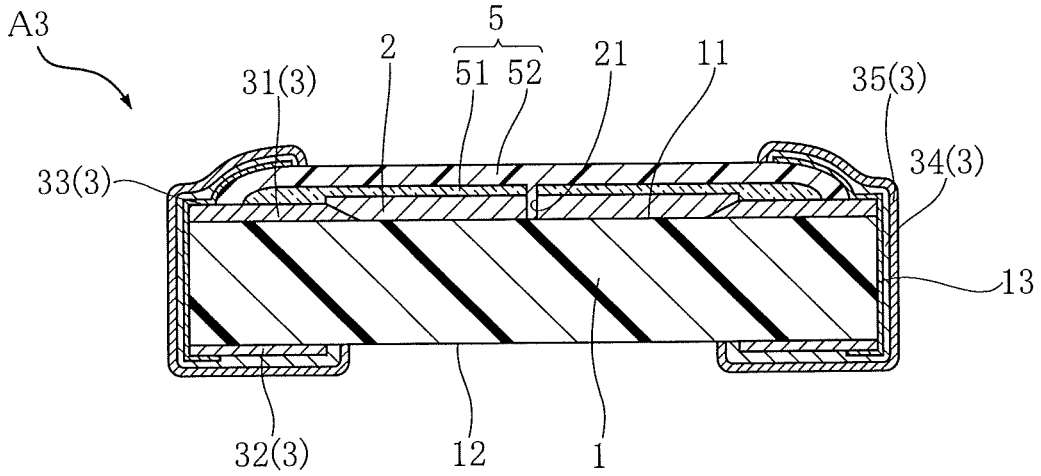
FIG. 19 is a cross-sectional view along the line XIX-XIX in FIG. 18.
Figure 20:
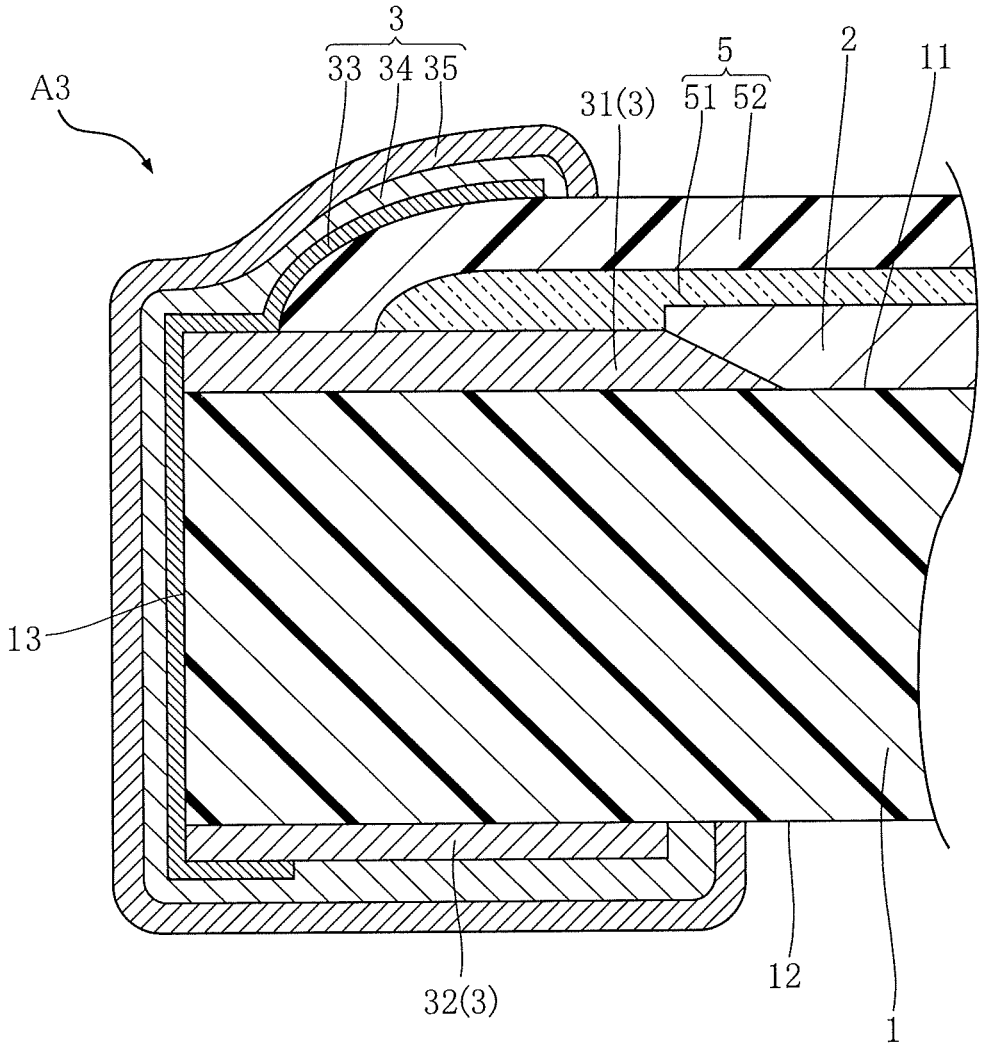
FIG. 20 is a partial enlarged cross-sectional view showing a part of FIG. 19.

The following describes a chip resistor A3 according to a third embodiment of the present invention, with reference to FIGS. 18 to 20. In these figures, elements that are the same as or similar to the elements of the chip resistor A1 described above are provided with the same reference signs, and descriptions thereof are omitted.

FIG. 18 is a plan view showing the chip resistor A3. FIG. 19 is a cross-sectional view along the line XIX-XIX in FIG. 18. FIG. 20 is a partial enlarged cross-sectional view showing apart of FIG. 19. For the convenience of understanding, FIG. 18 does not show the intermediate electrode 34 or the external electrode 35. As with the chip resistor A1, the chip resistor A3 is a thin-film chip resistor. In the present embodiment, the chip resistor A3 is rectangular in plan view.

The chip resistor A3 differs from the chip resistor A1 in that the protective layer 4 is omitted, and that the electrodes 3 and the protective film 5 have different structures.

As with the electrodes 3 in the chip resistor A1, the electrodes 3 according to the present embodiment include an upper electrode 31, a rear electrode 32, a side electrode 33, an intermediate electrode 34, and an external electrode 35. Among these electrodes, the side electrode 33, the intermediate electrode 34, and the external electrode 35 have different structures as compared to the corresponding electrodes in the chip resistor A1.

As shown in FIGS. 18 to 20, the side electrode 33 includes a pair of regions which are arranged on the side surfaces 13 of the substrate 1. The side electrode 33 covers parts of the upper electrode 31, the rear electrode 32, and the upper protective film 52, as well as the side surfaces 13. That is, the side electrode 33 has portions arranged on the side surfaces 13, and portions overlapping with the first mounting surface 11 and second mounting surface 12 of the substrate 1 in plan view. The side electrode 33 allows the upper electrode 31 and the rear electrode 32 to be electrically connected to each other. Accordingly, the upper electrode 31 and the side electrode 33 allow the resistor element 2 to be electrically connected to the rear electrode 32. In the present embodiment, the side electrode 33 is Ni—Cr alloy, for example. The side electrode 33 may be made of any metal as long as it is electrically conductive and resistant to sulfurization.

As shown in FIGS. 19 and 20, the intermediate electrode 34 covers the rear electrode 32 and the side electrode 33. In the present embodiment, the intermediate electrode 34 is a Ni plating layer, for example.

As shown in FIGS. 19 and 20, the external electrode 35 covers the intermediate electrode 34. In the present embodiment, the external electrode 35 is a Sn plating layer, for example.

As shown in FIGS. 18 to 20, the protective film 5 is a member that covers the resistor element 2 and protects the resistor element 2 from the exterior environment. The protective film 5 includes a lower protective film 51 and an upper protective film 52. The lower protective film 51 and the upper protective film 52 are stacked on each other. The lower protective film 51 and the upper protective film 52 are both electrical insulators. The lower protective film 51 is made of a material that is more resistant to a thermal shock than the upper protective film 52.

The lower protective film 51 covers the resistor element 2. The lower protective film 51 is positioned under the upper protective film 52 shown in FIGS. 19 and 20. The lower protective film 51 covers a part of a surface of the upper electrode 31 (i.e., an upper surface of the upper electrode 31 shown in FIGS. 19 and 20), as well as the resistor element 2. As shown in FIG. 18, the lower protective film 51 extends outwardly toward the side surfaces 13 of the substrate 1, beyond the boundary between the side electrode 33 and the upper protective film 52 when the chip resistor A3 is seen in plan view. The lower protective film 51 is made of a paste containing glass, for example.

The upper protective film 52 covers parts of the substrate 1 and the upper electrode 31, and the lower protective film 51 that covers the resistor element 2. The upper protective film 52 is positioned on the lower protective film 51 shown in FIGS. 19 and 20. In the present embodiment, parts of the upper protective film 52 are covered with the side electrode 33. The upper protective film 52 is made of a paste containing epoxy resin, for example.

Next, a method for manufacturing the chip resistor A3 will be described with reference to FIGS. 21 to 30. FIGS. 21 to 26 are plan views showing steps relating to the method for manufacturing the chip resistor A3. FIGS. 27 to 30 are perspective views showing steps relating to the method for manufacturing the chip resistor A3. Also, in FIGS. 27 and 28, the thicknesses of the resistor element 2, the upper electrode 31, the side electrode 33, the lower protective film 51, and the upper protective film 52 are disregarded in order to facilitate understanding.

Figure 21:
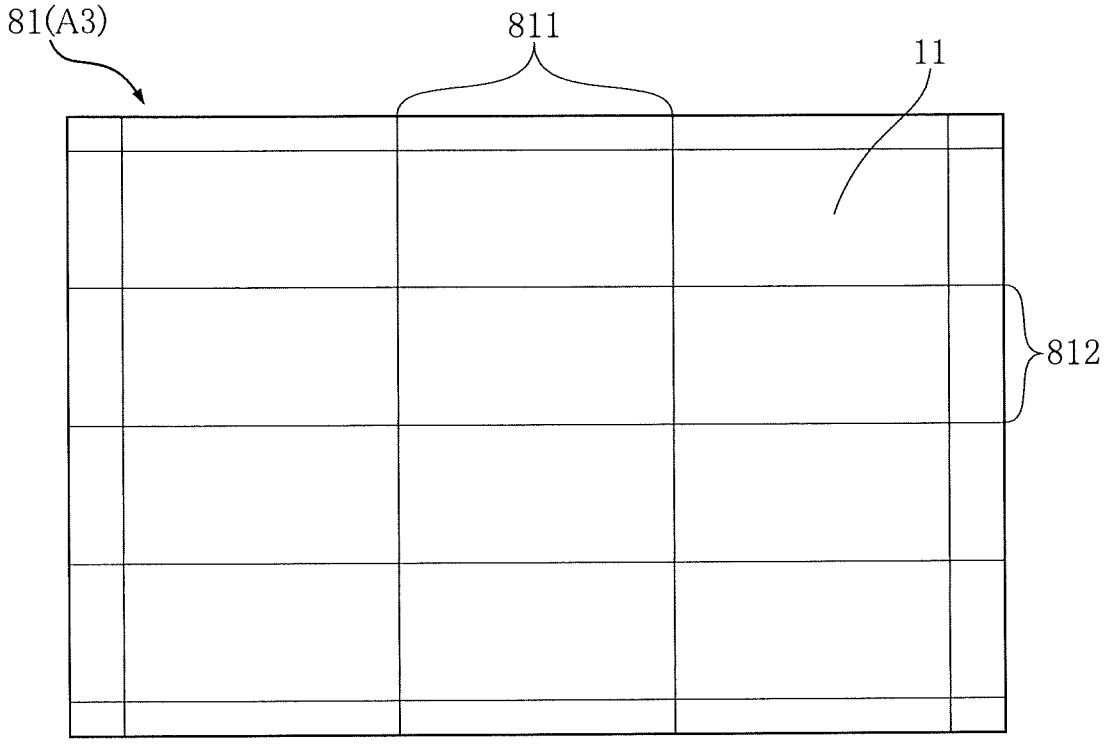
FIG. 21 is a plan view showing a step relating to a method for manufacturing the chip resistor shown in FIG. 18.

First, as shown in FIG. 21, a sheet-like substrate 81, made of alumina, is prepared. The sheet-like substrate 81 has a first mounting surface 11 and a second mounting surface 12. The first mounting surface 11 and the second mounting surface 12 face away from each other. FIG. 21 shows the first mounting surface 11 of the sheet-like substrate 81. In the first mounting surface 11, a plurality of primary dividing grooves 811 in a longitudinal direction in FIG. 21 and a plurality of secondary dividing grooves 812 in a lateral direction in FIG. 21 are formed in a grid pattern. The second mounting surface 12 has the same number of primary dividing grooves 811 and secondary dividing grooves 812 as the first mounting surface 11 (not shown). When seen in plan view, the positions of the primary dividing grooves 811 and the secondary dividing grooves 812 are the same in both the first mounting surface 11 and the second mounting surface 12. The sections created by the primary dividing grooves 811 and the secondary dividing grooves 832 are regions each corresponding to the substrate 1 of the chip resistor A3.

Figure 22:
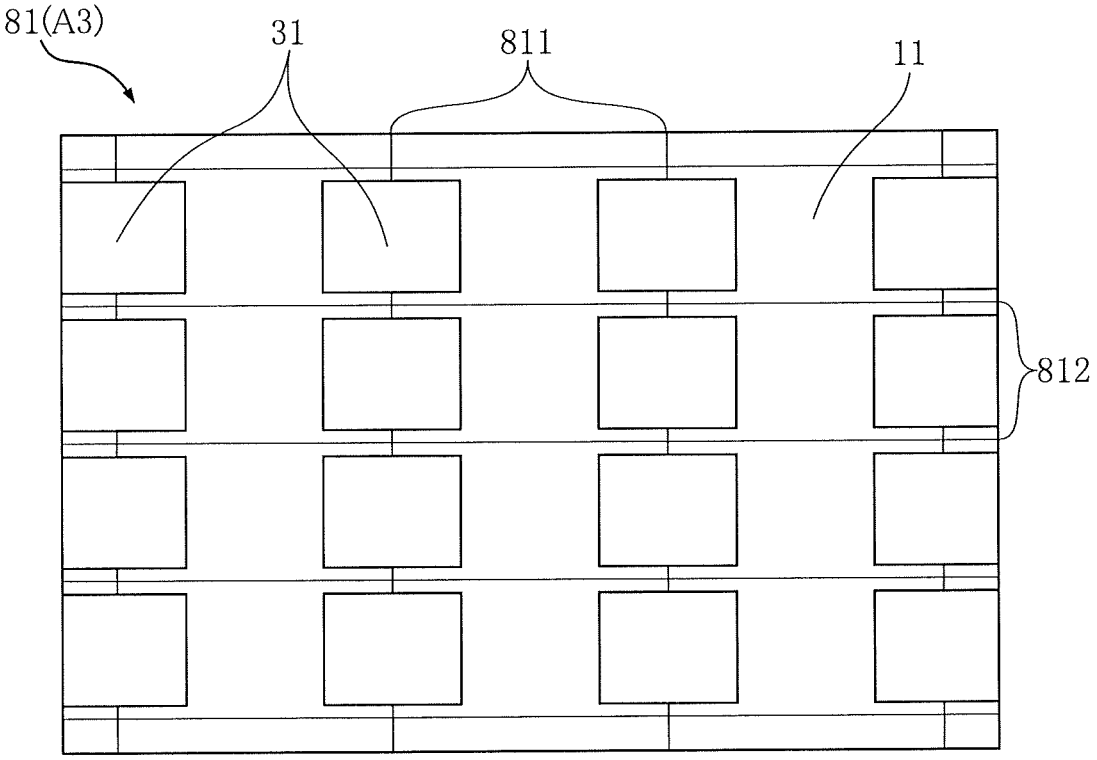
FIG. 22 is a plan view showing a step relating to a method for manufacturing the chip resistor shown in FIG. 18.

Next, as shown in FIG. 22, upper electrodes 31 are formed on the first mounting surface 11 of the sheet-like substrate 81, such that the upper electrodes 31 pass across the primary dividing grooves 811 of the sheet-like substrate 81. In addition, rear electrodes 32 are formed on the second mounting surface 12 of the sheet-like substrate 81, such that the rear electrodes 32 pass across the primary dividing grooves 811 (not shown). When seen in plan view, the positions of the upper electrodes 31 and the rear electrodes 32 are substantially the same. In the present embodiment, the upper electrodes 31 and the rear electrodes 32 are formed by printing a Ag paste containing glass frit on the first mounting surface 11 and the second mounting surface 12 with use of a silk screen, and firing the Ag paste in a firing furnace. Through the above step, the upper electrodes 31 and the rear electrodes 32, each including a pair of regions that are spaced part from each other, are formed on the first mounting surface 11 and the second mounting surface 12.

Figure 23:
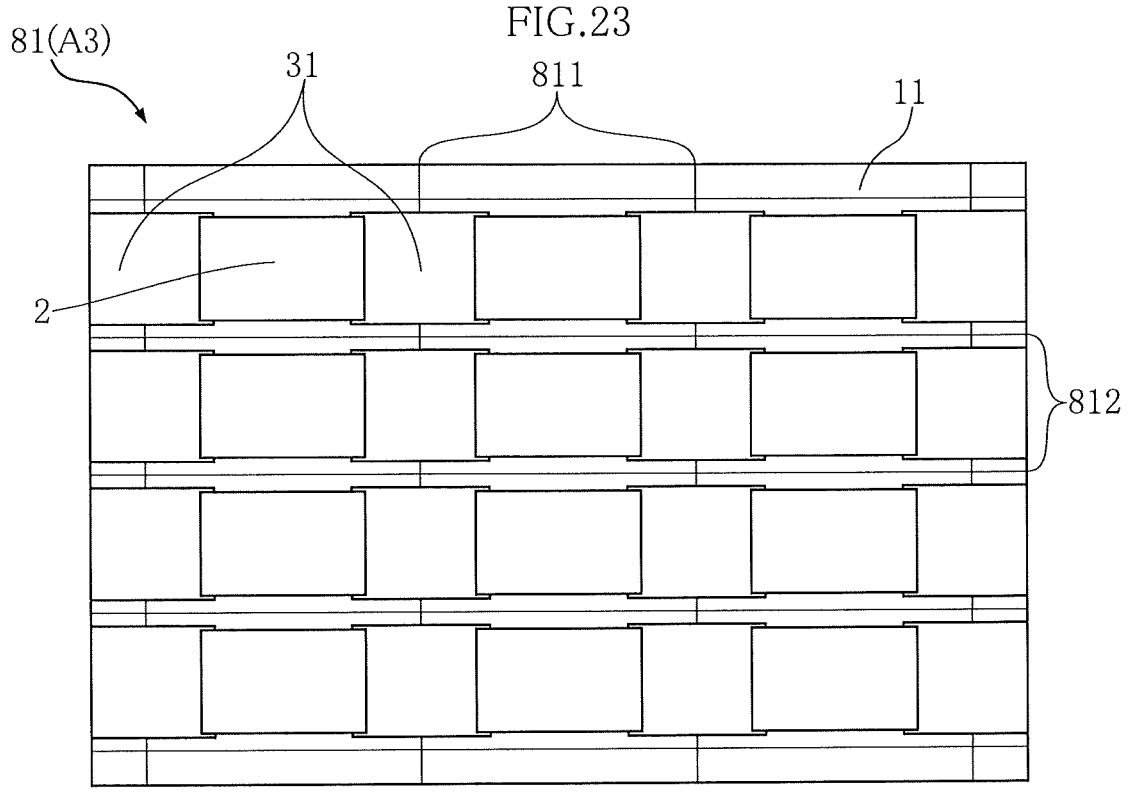
FIG. 23 is a plan view showing a step relating to a method for manufacturing the chip resistor shown in FIG. 18.

Next, as shown in FIG. 23, resistors 2, which are to be electrically connected to the upper electrodes 31, are mounted on the first mounting surface 11 of the sheet-like substrate 81, in the regions flanked by the pairs of regions of the upper electrodes 31. In the present embodiment, the resistors 2 are mounted by printing, with use of a silk screen, a paste containing glass frit and metal, such as $RuO_2$ or Ag—Pd alloy, and then by firing the paste in a firing furnace.

Figure 24:
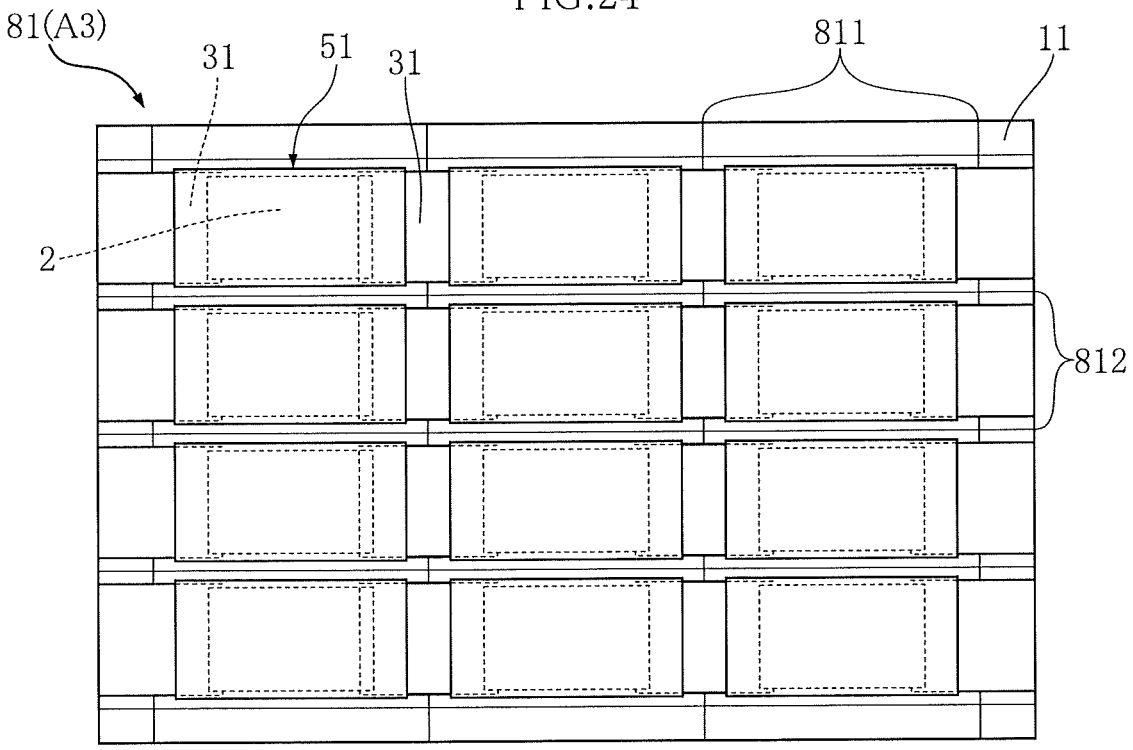
FIG. 24 is a plan view showing a step relating to a method for manufacturing the chip resistor shown in FIG. 18.

Next, as shown in FIG. 24, lower protective films 51 are formed to cover surfaces of the resistors 2. In the present embodiment, the lower protective films 51 are formed by printing a paste containing glass with use of a silk screen, and firing the paste in a firing furnace. Through the above step, the surfaces of the resistors 2 and parts of the upper electrodes 31 are covered with the lower protective films 51.

Figure 25:
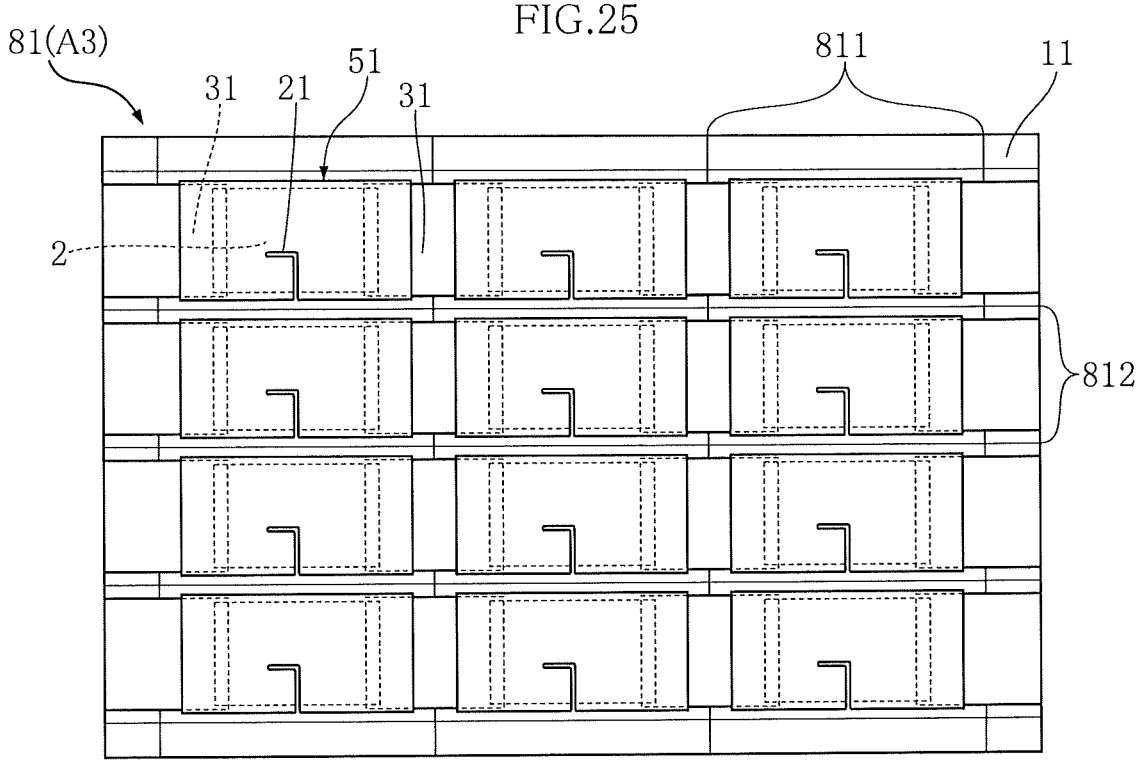
FIG. 25 is a plan view showing a step relating to a method for manufacturing the chip resistor shown in FIG. 18.

Next, as shown in FIG. 25, the trimming grooves 21 are formed in the resistors 2 to extend therethrough. The trimming grooves 21 are formed with a laser trimming apparatus (not shown). The procedure for forming the trimming grooves 21 are the same as the aforementioned procedure for forming the trimming grooves 21 in the chip resistor A1 shown in FIG. 10. With the above procedure, the trimming grooves 21, which are L-shaped in plan view, are formed in the resistors 2. Note that the trimming grooves 21 are formed with probes (not shown) for measuring a resistance value being in contact with exposed parts of pairs of upper electrodes 31 sandwiching the resistors 2.

Figure 26:
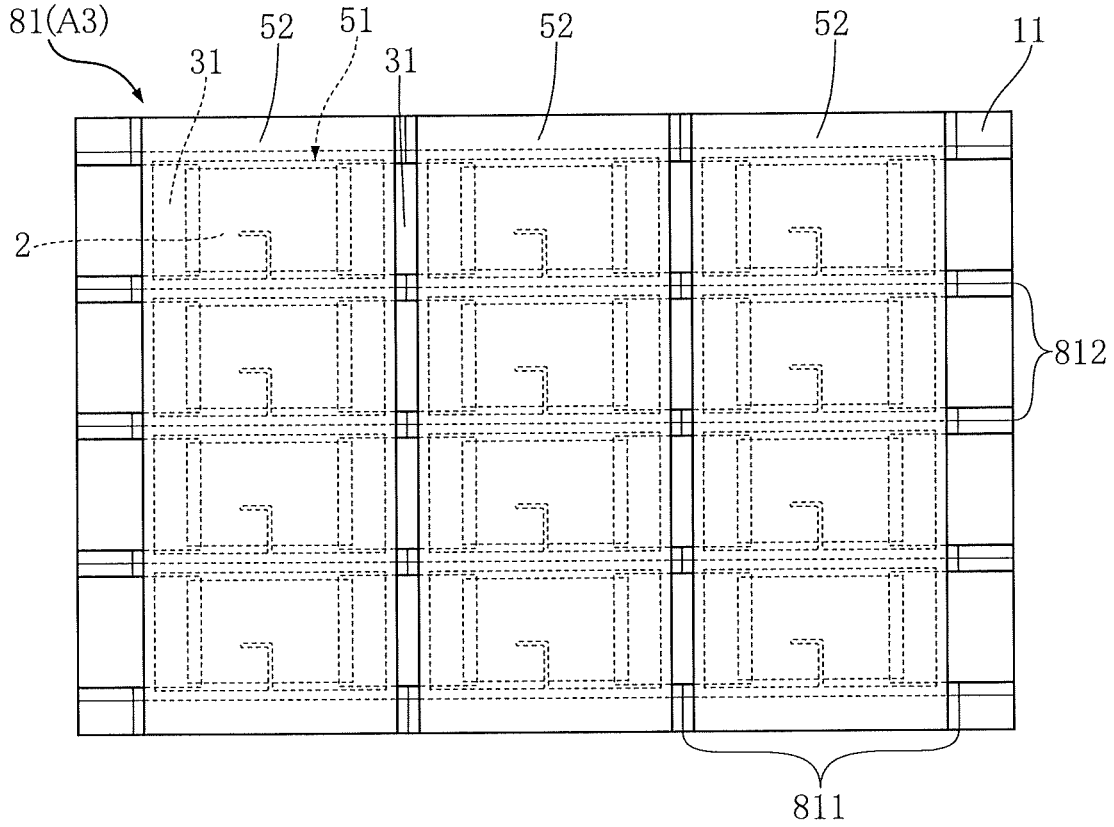
FIG. 26 is a plan view showing a step relating to a method for manufacturing the chip resistor shown in FIG. 18.

Next, as shown in FIG. 26, upper protective films 52 are formed over the first mounting surface 11 of the sheet-like substrate 81. At this time, the lower protective films 51, which covers the surfaces of the resistors 2 and parts of the upper electrodes 31, and, other parts of the upper electrodes 31, are both covered with the upper protective films 52. In the present embodiment, the upper protective films 52 are formed in the shape of a plurality of bands extending along the primary dividing grooves 811 of the sheet-like substrate 81, such that the upper protective films 52 pass across the secondary dividing grooves 812 of the sheet-like substrate 81. Also, in the present embodiment, the upper protective films 52 are formed by printing a paste containing epoxy resin with use of a silk screen and curing the paste. Note that the upper protective films 52 may be formed to be separate films corresponding one-to-one to the resistors 2, in the same manner as in the lower protective films 41 shown in FIG. 24.

Figure 27:
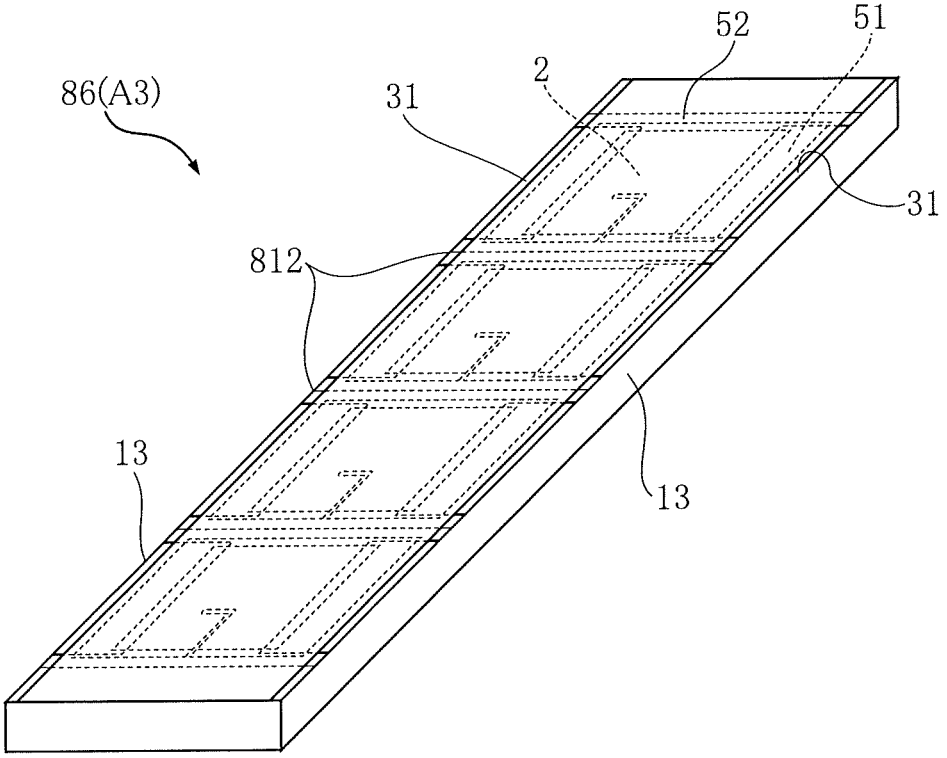
FIG. 27 is a perspective view showing a step relating to a method for manufacturing the chip resistor shown in FIG. 18.

Next, as shown in FIG. 27, the sheet-like substrate 81 is cut along the primary dividing grooves 811 of the sheet-like substrate 81 into a plurality of band-like substrates 86. At this time, side surfaces 13 are formed on both sides of each of the band-like substrates 86 along the longitudinal direction of the band-like substrates 86.

Figure 28:
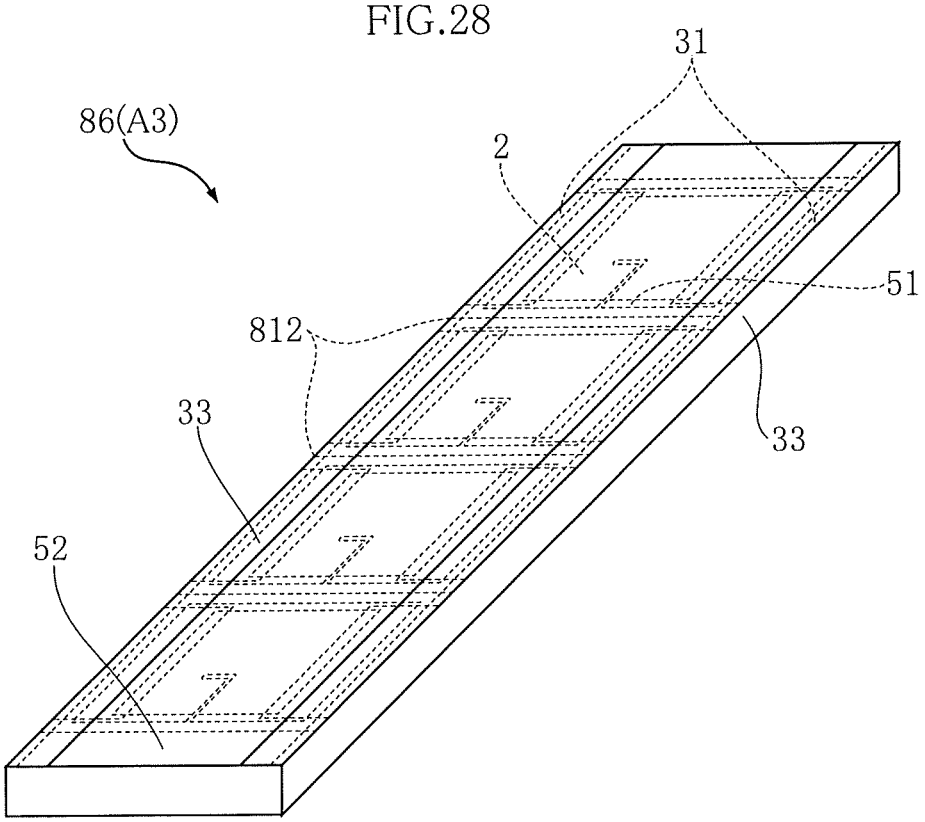
FIG. 28 is a perspective view showing a step relating to a method for manufacturing the chip resistor shown in FIG. 18.

Next, as shown in FIG. 28, side electrodes 33 are formed on the side surfaces 13 of each band-like substrate 86 that are located along both ends of the band-like substrate 86 in the longitudinal direction thereof, and are also formed on parts of the first mounting surface 11 and the second mounting surface 12. In the present embodiment, the side electrodes 33 are formed by forming a film of Ni—Cr alloy by physical vapor deposition (PVD) such as sputtering. In the formation of the side electrodes 33, the side surfaces 13, as well as parts of the respective surfaces of the upper electrodes 31, the rear electrodes 32, and the upper protective films 52 that are located perpendicular to the side surfaces 13, are collectively covered with the side electrodes 33 (the rear electrodes 32 are not shown). At this time, the side electrodes 33 make contact with the respective ends of the upper electrodes 31 and the rear electrodes 32 along the side surfaces 13. Through the above step, the upper electrodes 31 and the rear electrodes 32 become electrically connected to each other by means of the side electrodes 33.

Figure 29:
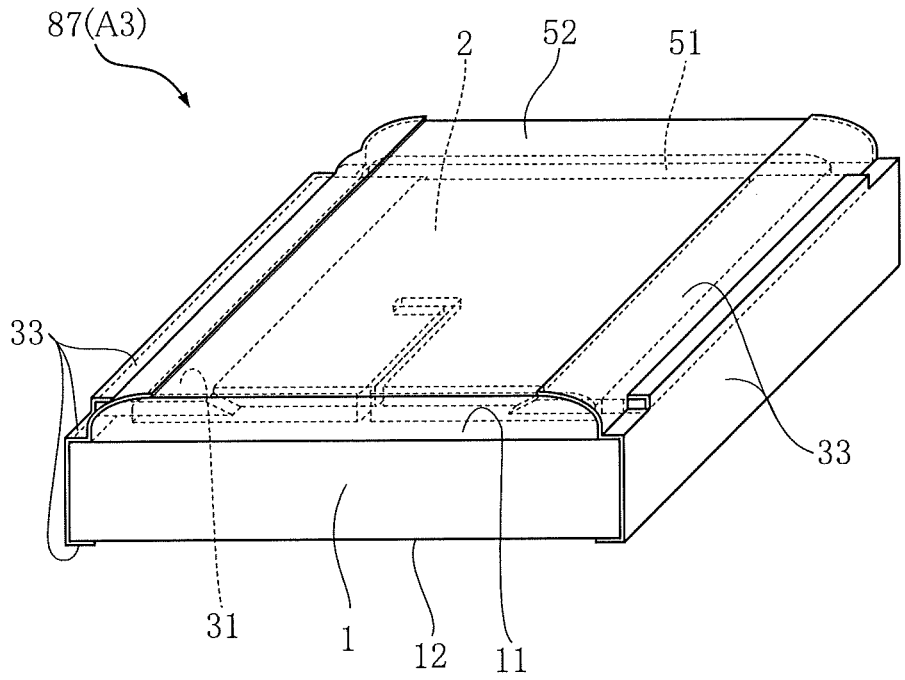
FIG. 29 is a perspective view showing a step relating to a method for manufacturing the chip resistor shown in FIG. 18.

Next, as shown in FIG. 29, the band-like substrates 86 are cut along the secondary dividing grooves 812 of the band-like substrates 86 to be divided into a plurality of pieces 87. At this time, the side electrodes 33 have the shape of a squared U that pinches the substrate 1. The side electrodes 33 are also formed on parts of the first mounting surface 11 and the second mounting surface 12 of the substrate 1. Specifically, the parts are located at both ends of each piece 87 that sandwich the parts of the side electrodes 33 formed on the parts of the surfaces of the upper electrodes 31 and the rear electrodes 32.

Figure 30:
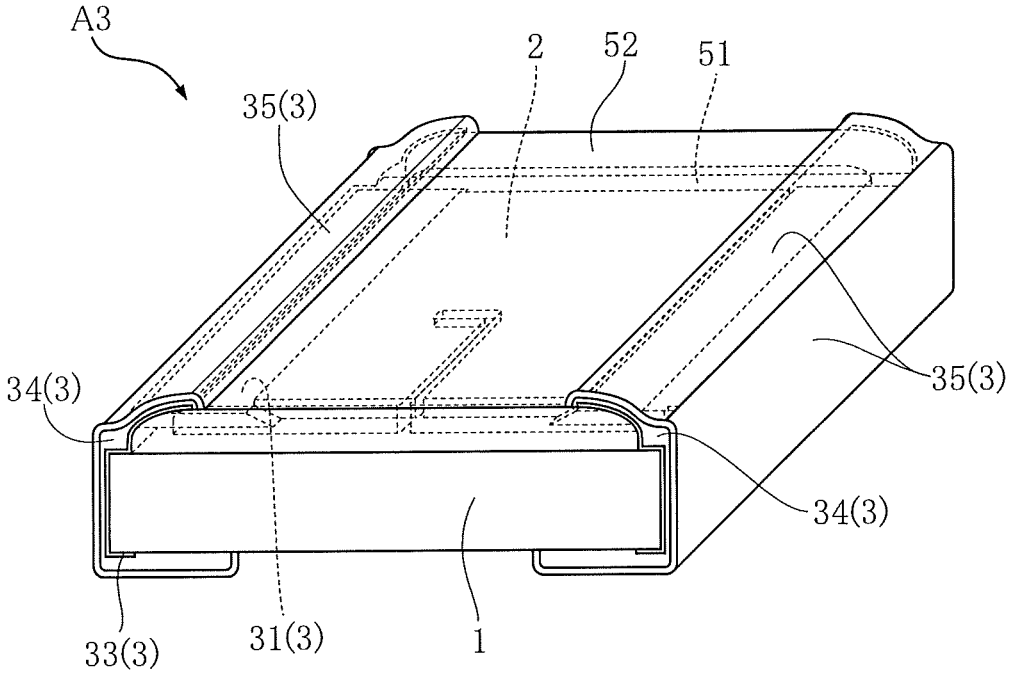
FIG. 30 is a perspective view showing a step relating to a method for manufacturing the chip resistor shown in FIG. 18.

Next, as shown in FIG. 30, for the pieces 87, intermediate electrodes 34 for covering the rear electrodes 32 and the side electrodes 33 are formed, and external electrodes 35 for covering the intermediate electrodes 34 are formed (the rear electrodes 32 are not shown). In the present embodiment, the intermediate electrodes 34 are formed by Ni plating and the external electrodes 35 are formed by Sn plating. Through the above step, pairs of electrodes 3 that electrically connect to the resistors 2 are formed. Upon completion of all of the above steps, chip resistors A3 are formed.

The following describes the operation and effects of the chip resistor A3.

According to the present embodiment, the chip resistor A3 has the lower protective film 51 and the upper protective film 52 that are stacked on each other, and parts of the upper electrode 31 are covered with the lower protective film 51. The lower protective film 51 is made of a material that is more resistant to a thermal shock than the upper protective film 52. Accordingly, even if a crack occurs in the upper protective film 52 due to a thermal shock at top portions of the plating layers that serve as the intermediate electrode 34 and the external electrode 35 (i.e., boundary between the plating layers and the upper protective film 52 in plan view), the lower protective film 51 prevents development of the crack. Since the crack does not cause exposure of the upper electrode 31, the sulfide gas generated in the vicinity of the chip resistor A3 does not enter the upper electrode 31 via the crack. Accordingly, even if a crack occurs in the upper protective film 52 due to a thermal shock at the electrodes 3, disconnection of the electrodes 3 caused by sulfurization can be prevented.

Sulfurization of the side electrode 33 is prevented by forming the side electrode 33 with Ni—Cr alloy that is electrically conductive and resistant to sulfurization. This makes it possible to prevent disconnection of the side electrode 33 and sulfurization of the upper electrode 31 via the side electrode 33. In addition, since the side electrode 33 is formed by physical vapor deposition such as sputtering, the adherence of the side electrode 33 to the upper protective film 52 which is an electrical insulator is further improved. Since the intermediate electrode 34 which is a Ni plating layer and the side electrode 33 are prevented from peeling, concerns about a part of the upper electrode 31 being exposed as a result of the peeling and causing the exposed part to be sulfurized are resolved.

Fourth Embodiment

Figure 31:
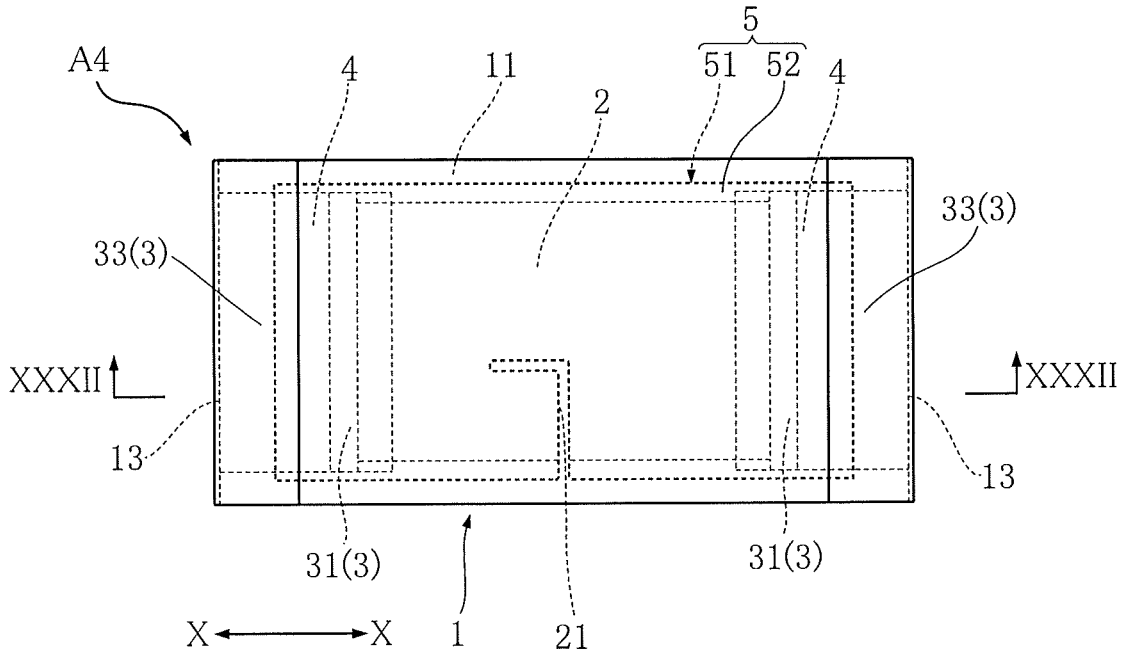
FIG. 31 is a plan view showing a chip resistor according to a fourth embodiment of the present invention.
Figure 32:
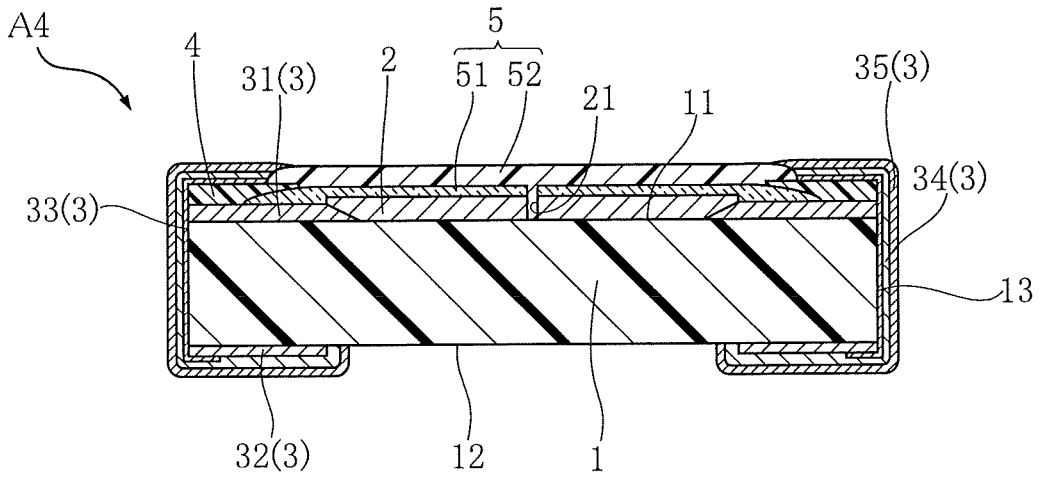
FIG. 32 is a cross-sectional view along the line XXXII-XXXII in FIG. 31.
Figure 33:
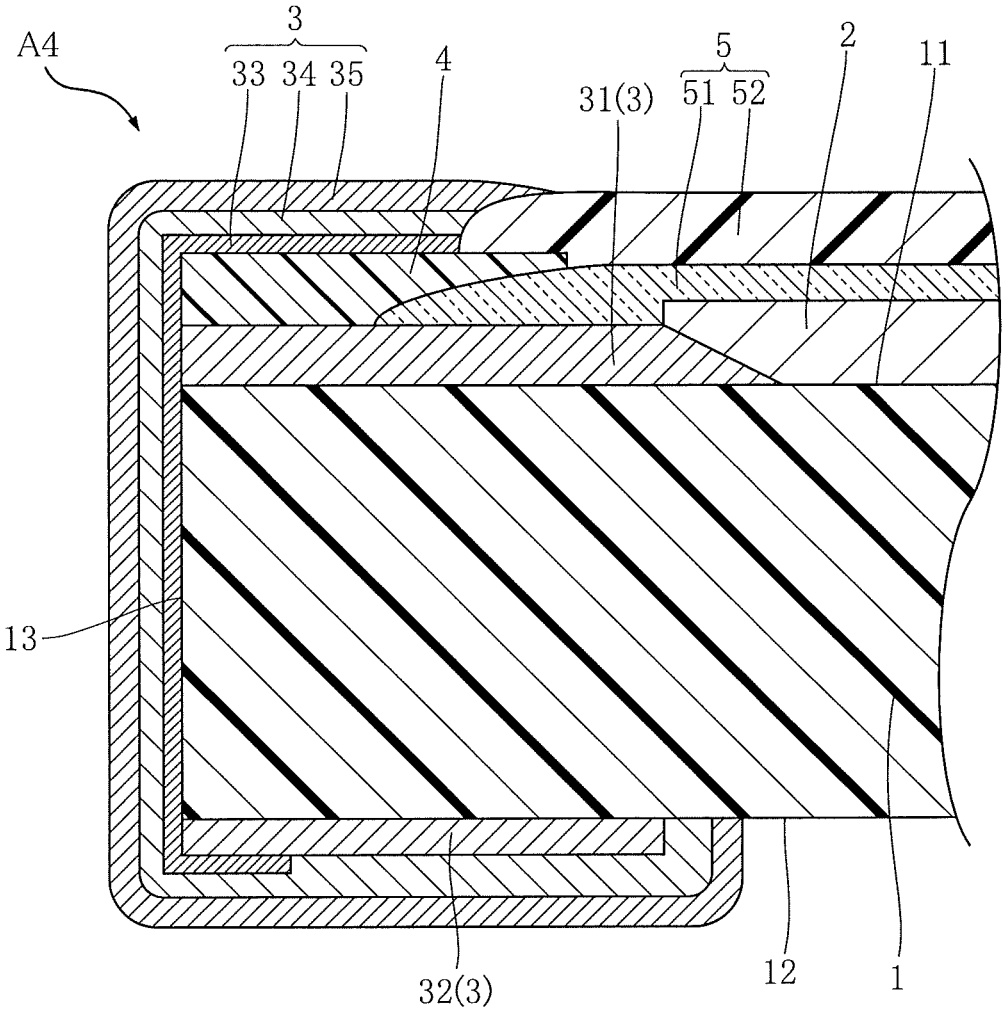
FIG. 33 is a partial enlarged cross-sectional view showing a part of FIG. 32.

The following describes a chip resistor A4 according to a fourth embodiment of the present invention, with reference to FIGS. 31 to 33. In these figures, elements that are the same as or similar to the elements of the chip resistor A1 described above are provided with the same reference signs, and descriptions thereof are omitted.

FIG. 31 is a plan view showing the chip resistor A4. FIG. 32 is a cross-sectional view along the line XXXII-XXXII in FIG. 31. FIG. 33 is a partial enlarged cross-sectional view showing a part of FIG. 32. For the convenience of understanding, FIG. 31 does not show the intermediate electrode 34 or the external electrode 35. As with the chip resistor A1, the chip resistor A4 is a thin-film chip resistor. In the present embodiment, the chip resistor A4 is rectangular in plan view.

The chip resistor A4 differs from the chip resistor A1 in terms of the structures of the protective layer 4 and the protective film 5.

As shown in FIGS. 31 to 33, the protective layer 4 includes a pair of regions that are spaced apart from each other and formed on an upper surface of the upper electrode 31. The protective layer 4 is more resistant to sulfurization than the upper electrode 31. In the present embodiment, the protective layer 4 partially covers the upper electrode 31 and the lower protective film 51. Note that the protective layer 4 may not cover parts of the lower protective film 51. In the present embodiment, each region of the protective layer 4 is covered with the side electrode 33 and the upper protective film 52, and is in contact with the side electrode 33 at a side aligned with a corresponding side surface 13 of the substrate 1. The protective layer 4 according to the present embodiment is made of a paste containing: glass and a metal oxide composed of Ru and the like; carbon particles (i.e., carbon black); and epoxy resin, similarly to the first protective layer 41 of the chip resistor A1. In this case, the protective layer 4 is electrically conductive. The protective layer 4 may be an electrical insulator that is made of a paste containing glass, for example.

As shown in FIGS. 31 to 33, the protective film 5 is a member that covers the resistor element 2 and protects the resistor element 2 from the exterior environment. The protective film 5 includes a lower protective film 51 and an upper protective film 52. The lower protective film 51 and the upper protective film 52 are stacked on each other. The lower protective film 51 and the upper protective film 52 are both electrical insulators. The lower protective film 51 is made of the same material as the lower protective film 51 of the chip resistor A3, and the upper protective film 52 is made of the same material as the upper protective film 52 of the chip resistor A3.

The lower protective film 51 covers the resistor element 2. The lower protective film 51 is positioned under the upper protective film 52 shown in FIGS. 32 and 33. As with the chip resistor A3, the lower protective film 51 covers a part of a surface of the upper electrode 31 (i.e., an upper surface of the upper electrode 31 shown in FIGS. 32 and 33), as well as the resistor element 2. As shown in FIG. 31, the lower protective film 51 extends outwardly toward the side surfaces 13 of the substrate 1, beyond the boundary between the side electrode 33 and the upper protective film 52 when the chip resistor A4 is seen in plan view.

The upper protective film 52 covers parts of the substrate 1 and the protective layer 4, and the lower protective film 51 that covers the resistor element 2. The upper protective film 52 is positioned on the lower protective film 51 shown in FIGS. 32 and 33. In the present embodiment, parts of the upper protective film 52 are in contact with the side electrode 33, the intermediate electrode 34 and the external electrode 35.

Next, a method for manufacturing the chip resistor A4 will be described with reference to FIG. 34. The method for manufacturing the chip resistor A4 is the same as the method for manufacturing the chip resistor A3 described above, in terms of the steps of: preparing the sheet-like substrate 81 and forming the upper electrodes 31 as shown in FIGS. 21 and 22; mounting the resistors 2 as shown in FIG. 23; forming the lower protective films 51 as shown in FIG. 24; and forming the trimming grooves 21 as shown in FIG. 25.

Figure 34:
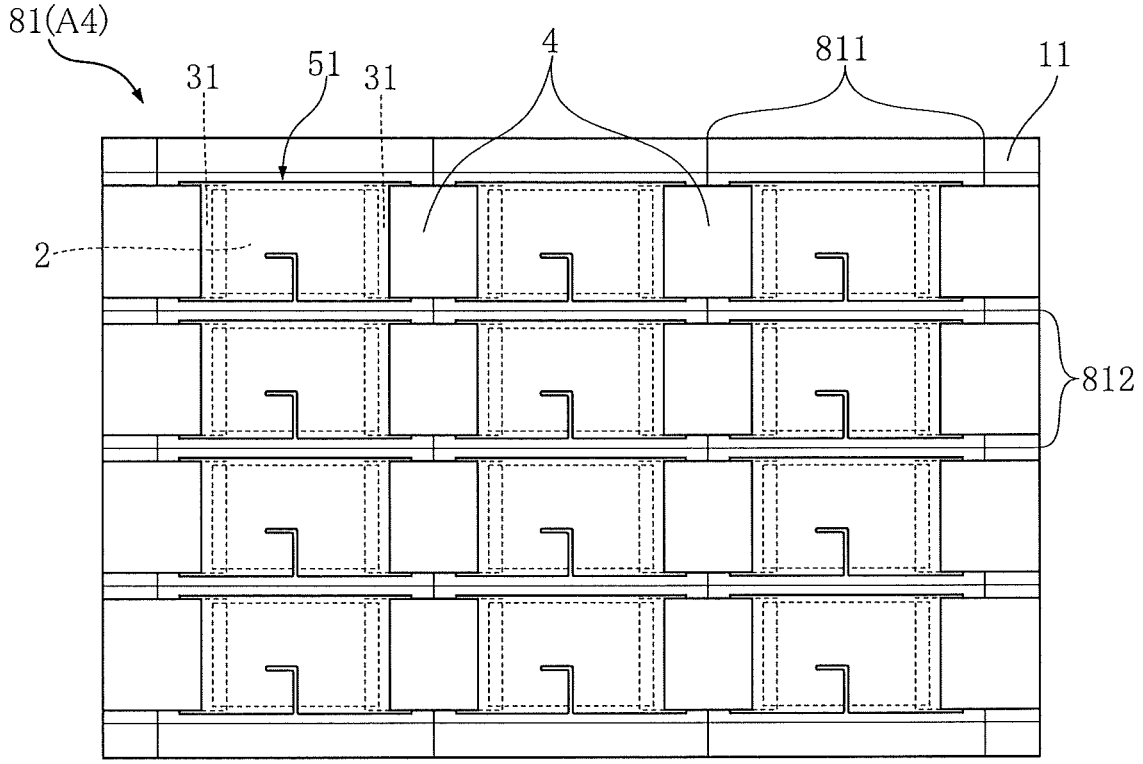
FIG. 34 is a plan view showing a step relating to a method for manufacturing the chip resistor shown in FIG. 31.

As shown in FIG. 34, after the trimming grooves 21 are formed in the resistors 2, protective layers 4, which are more resistant to sulfurization than the upper electrodes 31, are formed on exposed parts of the upper electrodes 31. In the present embodiment, the protective layers 4 are formed by printing, with use of a silk screen, a paste containing glass and a metal oxide composed of Ru and the like, carbon black, and epoxy resin, and curing the paste. The protective layers 4 in this case are electrically conductive. The protective layers 4 may be formed as electrical insulators by printing a paste containing glass with use of a silk screen, and firing the paste in a firing furnace. Through the above step, the exposed parts of the upper electrodes 31 and parts of the lower protective films 51 are covered with the protective layers 4.

Next, the upper protective films 52 are formed over the first mounting surface 11 of the sheet-like substrate 81. At this time, the lower protective films 51 covering the surfaces of the resistors 2 and parts of the upper electrodes 31, as well as parts of the protective layers 4, are covered with the upper protective films 52. The upper protective films 52 are formed in the same manner as in the film formation step in the method for manufacturing the chip resistors A3 shown in FIG. 26. The chip resistors A4 are manufactured through the same steps as in the chip resistors A3 after the formation of the upper protective films 52.

The following describes the operation and effects of the chip resistor A4.

As with the chip resistor A3, the present embodiment also employs the structure where parts of the upper electrode 31 are covered with the lower protective film 51. In this way, even if a crack occurs in the upper protective film 52 due to a thermal shock at the electrodes 3, disconnection of the electrodes 3 caused by sulfurization can be prevented. Also, with the inclusion of the protective layer 4, the upper surface of the upper electrode 31 is covered with not only the lower protective film 51 but also the protective layer 4. The protective layer 4 is more resistant to sulfurization than the upper electrode 31. This allows the chip resistor A4 to be more resistant to sulfurization than the chip resistor A3.

Chip resistors according to the present invention are not limited to those described in the above embodiments. Various design changes can be made to the specific configurations of the elements of chip resistors according to the present invention.

Technical configurations of a chip resistor and a manufacturing method therefor provided by the present invention are enumerated below as appendixes.

Appendix 1

A chip resistor comprising:

a substrate having a first mounting surface and a second mounting surface that face away from each other;

a pair of upper electrodes provided at both ends of the first mounting surface of the substrate;

a resistor element provided, on the first mounting surface of the substrate, between the pair of upper electrodes;

a protective film covering the resistor element and parts of the upper electrodes;

side electrodes electrically connected to the upper electrodes, each of the side electrodes having a portion arranged on a side surface of the substrate that is located between the first mounting surface and the second mounting surface of the substrate, and portions overlapping with the first mounting surface and the second mounting surface in a plan view of the substrate;

intermediate electrodes covering the side electrodes; and external electrodes covering the intermediate electrodes, wherein the protective film includes a lower protective film and an upper protective film that are stacked on each other, the lower protective film is made of a material that is more resistant to a thermal shock than the upper protective film, and the parts of the upper electrodes are covered with the lower protective film.

Appendix 2

The chip resistor according to Appendix 1, wherein the upper electrodes and the upper protective film are partially covered with the side electrodes.

Appendix 3

The chip resistor according to Appendix 1, further comprising a protective layer covering at least parts of upper surfaces of the upper electrodes and being more resistant to sulfurization than the upper electrodes, wherein at least a part of the protective layer is covered with the side electrodes.

Appendix 4

The chip resistor according to Appendix 3, wherein apart of the protective layer is covered with the upper protective film.

Appendix 5

The chip resistor according to Appendix 3 or 4, wherein the protective layer includes carbon particles.

Appendix 6

The chip resistor according to Appendix 3 or 4, wherein the protective layer is an electrical insulator.

Appendix 7

The chip resistor according to any one of Appendixes 1 to 6, wherein the lower protective film includes glass.

Appendix 8

The chip resistor according to any one of Appendixes 1 to 7, wherein the upper protective film includes epoxy resin.

Appendix 9

The chip resistor according to any one of Appendixes 1 to 8, wherein the side electrodes are made of Ni—Cr alloy.

Appendix 10

The chip resistor according to any one of Appendixes 1 to 9 further comprising a pair of rear electrodes provided at both ends of the second mounting surface of the substrate, wherein the side electrodes are electrically connected to the rear electrodes.

Appendix 11

The chip resistor according to Appendix 10, wherein the rear electrodes are covered with the intermediate electrodes.

Appendix 12

The chip resistor according to any one of Appendixes 1 to 11, wherein the substrate is an electrical insulator.

Appendix 13

The chip resistor according to Appendix 12, wherein the substrate is made of alumina.

Appendix 14

The chip resistor according to any one of Appendixes 1 to 13, wherein a trimming groove is formed in the resistor element to extend therethrough.

Appendix 15

The chip resistor according to any one of Appendixes 1 to 14, wherein the intermediate electrodes and the external electrodes are plating layers.

Appendix 16

The chip resistor according to Appendix 15, wherein the intermediate electrodes are Ni plating layers.

Appendix 17

The chip resistor according to Appendix 15, wherein the external electrodes are Sn plating layers.

Appendix 18

A method for manufacturing a chip resistor comprising the steps of:

preparing a sheet-like substrate having a first mounting surface and a second mounting surface that face away from each other, and forming, on the first mounting surface of the sheet-like substrate, an upper electrode having a pair of regions that are spaced apart from each other;

mounting a resistor on the first mounting surface of the sheet-like substrate, in a region flanked by the pair of regions of the upper electrode, such that that the resistor is electrically connected to the upper electrode;

forming a lower protective film covering the resistor element and a part of the upper electrode;

forming an upper protective film covering the lower protective film;

dividing the sheet-like substrate into a plurality of band-shaped substrates;

forming side electrodes on side surfaces of each band-like substrate that are located along both ends of the band-like substrate in a longitudinal direction thereof, and also on the first mounting surface and the second mounting surface, such that the side electrodes are electrically connected to the upper electrode; and forming intermediate electrodes covering the side electrodes, and external electrodes covering the intermediate electrodes.

Appendix 19

The method for manufacturing the chip resistor according to Appendix 18, wherein the side electrodes are formed to partially cover the upper electrode and the upper protective film.

Appendix 20

The method for manufacturing the chip resistor according to Appendix 18, further comprising the step of forming a protective layer that covers at least a part of an upper surface of the upper electrode and is more resistant to sulfurization than the upper electrode.

Appendix 21

The method for manufacturing the chip resistor according to Appendix 20, wherein the protective layer is formed in a process involving printing.

Appendix 22

The method for manufacturing the chip resistor according to Appendix 21, wherein the side electrodes are formed to cover at least a part of the protective layer.

Appendix 23

The method for manufacturing the chip resistor according to Appendix 22, wherein the upper protective film is formed to cover a part of the protective layer.

Appendix 24

The method for manufacturing the chip resistor according to any one of Appendixes 18 to 23, wherein the lower protective film is formed in a process involving printing.

Appendix 25

The method for manufacturing the chip resistor according to any one of Appendixes 18 to 24, wherein the upper protective film is formed in a process involving printing.

Appendix 26

The method for manufacturing the chip resistor according to any one of Appendixes 18 to 25, wherein the side electrodes are formed by physical vapor deposition.

Appendix 27

The method for manufacturing the chip resistor according to Appendix 26, wherein the physical vapor deposition is a sputtering method.

Appendix 28

The method for manufacturing the chip resistor according to Appendixes 18 to 27, wherein the intermediate electrodes and the external electrodes are formed by plating.

Appendix 29

The method for manufacturing the chip resistor according to Appendix 28, further comprising the step of dividing the elongated substrates into a plurality of pieces, before the step of forming the intermediate electrodes and the external electrodes.

Appendix 30

The method for manufacturing the chip resistor according to any one of Appendixes 18 to 29, further comprising the step of forming, on the second mounting surface of the sheet-like substrate, a rear electrode having a pair of regions that are spaced apart from each other.

Appendix 31

The method for manufacturing the chip resistor according to any one of Appendixes 18 to 30, further comprising the step of forming a trimming groove that penetrates through the resistor element.

The invention claimed is:

1. A chip resistor comprising:

a substrate including a first surface, a second surface opposite to the first surface, and a side surface disposed between the first surface and the second surface in a thickness direction of the substrate, the first surface including a first end part and a second end part that are spaced apart from each other in a first direction in plan view;

an upper electrode located on the first end part of the first surface;

a resistor element located on the first surface of the substrate and electrically connected to the upper electrode;

a first insulating layer covering the upper electrode and the resistor element;

a second insulating layer formed on the first insulating layer;

a protective layer formed on the upper electrode and including a portion located between the first insulating layer and the second insulating layer in the thickness direction; and a side electrode electrically connected to the upper electrode and including a first portion and a second portion, the first portion being located on the side surface of the substrate, the second portion overlapping with the first surface of the substrate in plan view, wherein the upper electrode includes a first portion located between the substrate and the resistor element in the thickness direction, and a second portion that does not overlap with the resistor element in plan view, and that has a uniform thickness, the protective layer includes an inner surface held in contact with the upper electrode and an outer surface opposite to the inner surface, and the outer surface is greater in length measured in the first direction than the inner surface, and the second portion of the side electrode and the second insulating layer have respective ends held in contact with each other on the outer surface of the protective layer.

2. The chip resistor according to claim 1, wherein the protective layer is made of an electroconductive material.

3. The chip resistor according to claim 2, wherein the protective layer comprises glass, metallic oxide and carbon black.

4. The chip resistor according to claim 1, wherein the protective layer is greater in maximum thickness than the first insulating layer.

5. The chip resistor according to claim 1, wherein the inner surface and the outer surface of the protective layer are flat.

6. The chip resistor according to claim 1, wherein the end of the second insulating layer does not overlap with the inner surface of the protective layer in plan view.

7. The chip resistor according to claim 1, wherein the first insulating layer has an end that is closer to the side surface of the substrate than is the second insulating layer in the first direction.

8. The chip resistor according to claim 1, wherein the second portion of the side electrode is located on the protective layer and an entirety of the second portion of the side electrode is spaced apart from the upper electrode.

9. The chip resistor according to claim 1, wherein the protective layer and the upper electrode have respective end faces held in contact with the first portion of the side electrode.

10. The chip resistor according to claim 9, wherein the side surface of the substrate, the end face of the protective layer, and the end face of the upper electrode are flush with each other.

11. The chip resistor according to claim 1, further comprising an intermediate electrode covering the side electrode, and an outer electrode covering the intermediate electrode.

12. The chip resistor according to claim 11, wherein the side electrode is made of a Ni—Cr alloy, the intermediate electrode comprises a Ni-plating layer, and the outer electrode comprises a Sn-plating layer.

13. The chip resistor according to claim 11, wherein the intermediate electrode and the outer electrode have respective ends held in contact with the second insulating layer.

14. The chip resistor according to claim 1, wherein the first portion of the upper electrode has an inclined end face held in contact with the resistor element.

15. The chip resistor according to claim 1, further comprising a rear electrode located on the second surface of the substrate and electrically connected to the side electrode.

16. The chip resistor according to claim 15, wherein the rear electrode has an end face that is flush with the side surface of the substrate and held in contact with the first portion of the side electrode.

17. The chip resistor according to claim 15, wherein the side electrode includes a third portion that is parallel to the first portion of the side electrode and held in contact with the rear electrode.

18. The chip resistor according to claim 15, wherein the rear electrode is greater in length measured in the first direction than is the protective layer.

* * * * *